United States Patent [19]

Braunlin et al.

[11] 4,424,108

[45] Jan. 3, 1984

[54] PROCESS FOR HEATING COAL-OIL SLURRIES

[75] Inventors: Walter A. Braunlin, Spring, Tex.; Alan Gorski, Lovington, N. Mex.; Leo J. Jaehnig, New Orleans, La.; Clifford J. Moskal, Oklahoma City, Okla.; Joseph D. Naylor, Houston, Tex.; Krishnia Parimi, Allison Park, Pa.; John V. Ward, Arvada, Colo.

[73] Assignee: The Pittsburg & Midway Coal Mining Co., Englewood, Colo.

[21] Appl. No.: 337,301

[22] Filed: Jan. 8, 1982

[51] Int. Cl.[3] ..... C10G 1/00

[52] U.S. Cl. ..... 208/8 LE; 208/DIG. 1

[58] Field of Search ..... 208/8 LE, DIG. 1

[56] References Cited

U.S. PATENT DOCUMENTS

| | | | |
|---|---|---|---|
| 1,923,865 | 8/1933 | Handforth | 208/DIG. 1 |
| 4,159,238 | 6/1979 | Schmid | 208/8 LE X |
| 4,189,375 | 2/1980 | Kirby et al. | 208/8 LE |

FOREIGN PATENT DOCUMENTS

| | | | |
|---|---|---|---|
| 505496 | 5/1939 | United Kingdom | 208/8 LE |

OTHER PUBLICATIONS

Sandia Laboratories, "1980 GEO Energy Technology" at p. 17, Nov. 1979.

Trager et al., "Engineering Kinetics of Short Residence Time Coal Liquefaction Processes", Apr. 1979.

Traeger et al., "Coal Liquefaction Short Residence Time Process Research", Second Quarterly Report, 1/1/-3/1/79.

Traeger et al., "Preheater Studies in Coal Liquefaction", Annual Report, Oct. 1977-Sep. 1978.

Bulletin 633, Bureau of Mines, United States Department of The Interior; "Hydrogenation of Coal and Tar", 1967.

P. J. Larosa, "Coal Solvents Slurry and Preheating System Study for SRC Type Coal Liquefaction Processes", 1976.

P. W. Laughrey et al., "Design of Preheaters and Heat Exchangers for Coal-Hydrogenation Plants," May 1950 at p. 385.

H. L. Fein et al., "Design Study for a Coal-Oil Slurry Plumping and Preheating System", 1978 begins at p. 596.

Kimmel et al., "Coal Liquefaction Design Practices Manual", Final Report, Jul. 1976.

Talwalkar et al. for Institute of Gas Technology, "Heat Transfer in Slurry Preheaters for Coal Liquefaction Plants", at p. 6, 1980.

Hughmark, Chem. Eng. Process, "Holdup in Gas-Liquid Flow", vol. 58, No. 4.

*Primary Examiner*—William G. Wright

*Attorney, Agent, or Firm*—Arnold, White & Durkee

[57] ABSTRACT

Controlling gas to slurry volume ratio to achieve a gas holdup of about 0.4 when heating a flowing coal-oil slurry and a hydrogen containing gas stream allows operation with virtually any coal to solvent ratio and permits operation with efficient heat transfer and satisfactory pressure drops. The critical minimum gas flow rate for any given coal-oil slurry will depend on numerous factors such as coal concentration, coal particle size distribution, composition of the solvent (including recycle slurries), and type of coal. Further system efficiency can be achieved by operating with multiple heating zones to provide a high heat flux when the apparent viscosity of the gas saturated slurry is highest. Operation with gas flow rates below the critical minimum results in system instability indicated by temperature excursions in the fluid and at the tube wall, by a rapid increase and then decrease in overall pressure drop with decreasing gas flow rate, and by increased temperature differences between the temperature of the bulk fluid and the tube wall. At the temperatures and pressures used in coal liquefaction preheaters the coal-oil slurry and hydrogen containing gas stream behaves essentially as a Newtonian fluid at shear rates in excess of 150 $sec^{-1}$. The gas to slurry volume ratio should also be controlled to assure that the flow regime does not shift from homogeneous flow to non-homogeneous flow. Stable operations have been observed with a maximum gas holdup as high as 0.72.

41 Claims, 29 Drawing Figures

PROCESS FOR HEATING COAL-OIL SLURRIES

The Government of the United States of America has rights in this invention pursuant to contracts Nos. DEAC-O1-79ET10104, and DE-ACO5-780R03055 awarded by the U.S. Department of Energy to The Pittsburg & Midway Coal Mining Co., a subsidiary of Gulf Oil Corporation.

BACKGROUND

1. Field of the Invention

The present invention relates to control of a three-phase flowing system during heating. More particularly, the invention relates to a process of heating coal-oil slurries and hydrogen containing gas streams with minimum pressure drops, efficient heat transfer, and stable flow conditions.

2. State of the Art

Processes designed to convert naturally occurring carbonaceous material having high ash and sulphur content into low ash, low sulphur fuels have been known since early in the twentieth century. U.S. Pat. No. 4,159,238, the "Schmid" patent which is hereby incorporated by reference, describes an integrated coal liquefaction-gasification process. In that system pulverized raw coal is mixed with a recycle slurry and fed along with a hydrogen containing gas to a tubular preheater furnace where the coal is partially dissolved in the recycled slurry. The effluent from the preheater is then fed to a dissolver for further reaction. The effluent from the dissolver passes to a vapor/liquid separation system. The hot overhead vapor stream is removed from one outlet while a slurry distillate is removed from another outlet.

Both the vapor stream and the slurry stream are further fractionated. One fraction of the slurry product stream is fed to a gasifier where synthesis gas is produced. This gas satisfies the fuel requirements of the entire coal liquefaction-gasification process. A portion of the synthesis gas is converted in a shift reactor to produce the makeup hydrogen requirements of the system.

Although great strides have been made in designing commercially feasible coal liquefaction systems, use of such systems has not been economic. One persistent problem in designing coal liquefaction systems has been the design of the preheater. In the preheater a coal-oil slurry is heated to an outlet temperature between about 680° F. (360° C.) and about 870° F. (466° C.). The major reasons for the design difficulties are the unusual chemical and physical behavior of coal-oil slurries as they heat. Very little is known with certainty about the chemical reactions and physical phenomenon that take place as coal-oil slurries flow through a preheater.

Recent work at Sandia National Laboratories has been directed towards characterization of short residence time reactions occurring in coal liquefaction preheaters. Out of that research a simplified three step model of preheater chemical and physical effects has been developed. These steps are: initial swelling of the coal particle, its dissolution, and continued reaction of the primary disintegration products.

In the swelling stage, coal-solvent interactions are believed to control. This stage is characterized by solvent loss and formation of what is known as a "gel". The viscosity of the fluid in this stage is high and increases with temperature. Although a considerable thickening of the slurry has been observed in the slurry mixing tank where the slurry may remain for long periods of time at temperatures between 300° F. (149° C.) and 350° F. (177° C.), the temperature range of this gel stage in the preheater is generally considered to be 460° F. (237° C.) to 520° F. (271° C.).

The swelling stage is followed by disintegration of the gel phase and formation of free radicals as the thermal energy applied with continued heating breaks the chemical bonds holding the coal molecules together. In this phase, the inorganic matter separates from the coal particle as it disintegrates. The free radicals that are formed are stabilized by hydrogen. The source of the hydrogen is perhaps the coal itself. The extent to which intra-hydrogen transfer contributes to stabilization of coal free radicals is unknown. Conceptually, rearrangement of coal molecules is believed to satisfy the initial hydrogen requirement. Additional hydrogen demand is believed to be met by transfer of hydrogen from the carrier solvent and then eventually by transfer from the gas phase. The temperature range for this disintegration stage is believed to be 520° F. (271° C.) to 750° F. (399° C.).

With continued heating, more thermal cleavage occurs with formation of free radicals. These free radicals are also stabilized by hydrogen. The source of this hydrogen is believed to be either hydrogen available from the solvent or hydrogen available from the gas phase. Interactions between the liquid and gas phases become critical in this stage where the viscosity of the slurry starts decreasing with increasing temperature. Also in this stage, some of the free radicals recombine with coal or solvent depending on the temperature.

The different products of coal solvation reactions are commonly classified in terms of their solubilities are preasphaltenes, asphaltenes, and oils. Preasphaltenes are products soluble in tetrahydrofuran and insoluble in benzene; asphaltenes are products soluble in benzene but insoluble in pentane; while oils are products soluble in pentane. All investigators do not, however, use the same solvents in classifying the products as preasphaltenes, asphaltenes, or oils. Throughout the specification and claims the above described classification system will be used.

Researchers at Sandia National Laboratories have recently concluded that the initial swelling of coal with conversion to preasphaltenes (tetrahydrofuran soluble products) is very rapid (under one minute) and primarily a function of temperature. Conversions of up to 65% were observed even after thirty seconds at 850° F. (454° C.) Unfortunately, these researchers did not investigate conversion to preasphaltenes at temperatures lower than 750° F. (399° C.). In a flowing preheater the coal-oil slurry would not be exposed to these high temperatures except at the heater outlet. Conversion level and the effect of reaction time on conversions at temperatures lower than 750° F. (399° C.) are unknown.

The rapid fragmentation of coal by which preasphaltenes are formed is followed by slower secondary reactions. Work at Sandia National Laboratories indicates that residence time and temperature will each have significant effects on formation of the lighter products asphaltenes (benzene soluble) and oils (Pentane soluble).

As a result of these reactions, the composition of the fluid changes along the length of the heater as a function of space-time and temperature. As the composition changes, so do the physical properties of the flowing medium. These physcial properties affect the fluid dynamic and heat transfer characteristics of the multiphase flowing system. For example, the slurry viscosity at any given point is thought to depend in part on its preasphaltene content and the solvent concentration. High preasphaltene content and loss of solvent are generally believed to be contributors to high viscosity. Further, the endothermic step in the preheater is generally associated with the swelling-disintegration stage of the preheater reactions. This stage is also characterized by high viscosity of the slurry and by hydrogen transfer from solvent to fragmenting coal to sustain coal solvation reactions.

Researchers have long recognized the need to grasp an understanding of the compositional changes occurring as a coal-oil slurry flows through a preheater. Until the physical changes which result as the composition of the stream changes have been characterized, design of a preheater which can be operated with minimum pressure drop and maximum heat transfer is not possible. As a result of the long standing interest in the chemical and physical behavior of coal-oil streams in preheaters certain observations and deductions therefrom have come to be generally accepted among researchers in the coal liquefaction art.

Beginning with the Germans preceding and during World War II, investigators have believed that coal-oil slurries dramatically and rapidly increase their viscosity in the temperature range associated with cracking of coal molecules into preasphaltenes. Researchers have further believed that the viscosity rapidly decreases once the preasphaltenes begin to disintegrate into asphaltenes and oils. Although different investigators report different temperature ranges for a viscosity peak, investigators typically report a sharp peak in viscosity at temperatures in the neighborhood of 600° F. (316° C.). This viscosity peak is illustrated in the viscosity curve reported by researchers at the Bureau of Mines demonstration plant at Louisiana, Mo. which is shown in curve A of FIG. 1.

This peak viscosity in a narrow region has generally been identified as the factor limiting pumping ability. Researchers have also generally believed that heat transfer in this region which is often referenced as the "gel stage" is very poor. Thus, in order to avoid coking and consequent plugging of preheaters in the gel stage and to avoid pumping the very viscous gel over long preheater segments a variety of techniques have been developed to rapidly raise the temperature of the coal-oil slurry above the region associated with the gel stage.

The Germans hydrogenated brown coal and bituminous coal with the Bergius process. The Germans operated with coal concentrations as high as possible to maximize economy but were limited by the point at which the coal-oil paste became to viscous to pump. In hydrogenation of brown coal at the Wesseling plant the Germans could process only about 35% by weight (moisture and ash free) Rhine coal in the slurry due to its swelling properties. Similar problems were experiened in German plants operating with high bituminous coal concentrations since the swelling would cause a rapid rise in viscosity to 10,000 centipoise (cp) in a temperature region near 600° F. (316° C.).

The Germans resorted to two methods to preheat high concentration bituminous coal slurries. In the older method, the preheater was divided into two sections. The slurry exited from the first section at a temperature below that where the high viscosities of the gel stage were encountered. At that point a hot stream of hydrogen was added to raise the temperature beyond the gel stage. In the second section of the preheater the combined streams of coal paste and hydrogen were heated to the reaction temperature. In this older method the Germans observed an extremely low heat transfer coefficient of about 6 kcal/M$^2$-hr-°C. (1.2 btu/hr-ft$^2$-°F.).

In the second method, a stream containing approximately 36% by weight coal content, called the thin paste, was heated to a temperature above the gel stage in heat exchangers while a second stream containing approximately 48% coal, called the thick paste, was heated to a temperature below the gel stage in the preheater. The two streams were then combined such that the temperature of the resulting mixture was above that of the gel stage.

The Bureau of Mines demonstration plant at Louisiana, Mo. also operated with the Bergius process. Researchers at that plant in a paper: Laughtory et. al. *Design of Preheaters and Heat Exchangers for Coal-Hydrogenation Plants*, May 1950 Transactions of the ASME at 385, evaluated the parameters of the coal-oil paste which were important to design a preheater. They concluded:

"[T]he main property of the coal paste which may determine the design and size of the coal-paste preheater is the viscosity.

Obviously, at a high viscosity of the paste, the heat transfer in the preheater is poor, and at a low viscosity it is good."

That plant operated with the preheater separated into four heating zones. The first zone heated the slurry from 200° F. (93° C.) to about 570° F. (299° C.). The slurry exiting from the first zone was then mixed with a hot stream of hydrogen at 710° F. (377° C.) and a hot stream of a heavy solids containing oil called "heavy oil letdown" (HOLD) at approximately 775° F. (413° C.). The stream entered the second heating zone at a temperature of approximately 630° F. (332° C.). Thus by adding the hot hydrogen and HOLD the slurry stream was quickly heated through the temperature range which those workers identified with high viscosity. Sufficient hydrogen was introduced to start the liquefaction of the coal. In the second heater cell the stream was heated to approximately 700° F. (371° C.); in the third it was heated to approximately 760° F. (404° C.); in the fourth the stream was heated to reaction temperature at approximately 815° F. (435° C.). The stream flowed through different cells at different velocities. The velocity in cell No. 1 was 3 ft/sec (0.9 m/sec); in cell No. 2 it was 8.5 ft/sec (2.6 m/sec); in cell No. 3 it was 9 ft/sec (2.7 m/sec); and in cell No. 4 it was 9.5 ft/sec (2.9 m/sec).

The Consol Fuel Process (CFS process) was studied at an Office of Coal Research (OCR) sponsored pilot plant at Cresap, W.Va. That plant was operated with solvent to coal weight ratios ranging from about 1.5 to about 4.7. Gaseous hydrogen was not added to the process as the hydrogen donor was the solvent. The system was designed for a 4,210 lb/hr (1,914 kg/hr) throughput with an average heat flux of 7,820 btu/hr-ft$^2$ (3,896 kcal/hr-m$^2$). The flow rate through the $\frac{3}{4}$" coil was 10.2 gal/min. Unusual viscosities and coking association with poor heat transfer were not reported by the investigators at Cresap.

The solvent refined coal (SRC) plant operating at Wilsonville, Ala. was designed to operate with fluid velocities between 2 and 8 ft/sec. The preheater was a tubular coil having a 1.116 in. I.D. (2.83 cm) and a 1.66 in. O.D. (4.22 cm). Makeup hydrogen was added at the inlet to the preheater at a design rate of about 5,000 SCF/hour (142 SCM/hr). Heat flux was specified to fall between a minimum of 5,000 btu/hr-ft$^2$ (13.5 M kcal/m$^2$-hr) and a maximum of 10,000 btu/hr-ft$^2$ (275 M kcal/m$^2$-hr). Data published in the Quarterly Technical Progress Report for January through December 1976 indicates that the Wilsonville preheater operated typically with lower heat fluxes in the neighborhood of 3,000 btu/hr/ft$^2$. Pressure drops as high as 120 lb/in$^2$ (83 newt/cm$^2$) were recorded for runs where the solvent to coal ratio was 2 to 1. Pressure drops of about 30 lb/in$^2$ (21 newt/cm$^2$) were recorded where the solvent to coal ratio was 3 to 1. Coking was also a problem in preheater coils. The coking was attributed to low velocities through the coil. Researchers at Wilsonville reported a peak viscosity in the temperature range between 700° F. (371° C.) and 800° F. (427° C.). Those investigators also studied the effect of gas to slurry ratios and could identify no significant effect under the conditions used in their heater.

The solvent refined coal (SRC) pilot plant operated at Fort Lewis, Wash., operated in both the SRC I and SRC II modes. Prior to the work conducted by applicants which led to the present invention the preheater used at Fort Lewis was a tubular coil with a nominal three-inch outside diameter. In that work almost all of the reaction hydrogen used in the dissolver was added at the inlet to the preheater. Small amounts of hydrogen were added as a purge in the dissolver to control temperature. Neither unusual pressure drops nor coking were observed.

As a result of the experiences reported by workers at the facilities described above researchers in the coal liquefaction art have come to believe that coal-oil slurries have certain characteristics which are important to preheater design. The slurries are believed to be pseudo-plastic. The apparent viscosities of coal-oil slurries are believed to decrease with increased shear rates up to shear rates in excess of 1000 sec$^{-1}$. Apparent viscosities of the slurries are also believed to increase dramatically in a relatively narrow temperature range. This temperature region is called the "gel" stage. Heat transfer coefficients are believed to be very low in the temperature region associated with the gel stage. The undesirable characteristics of high apparent viscosity and poor heat transfer are believed to get worse with increasing coal concentration.

Because of these characteristics, the coal/solvent ratio has been identified as a factor which will dictate design specifications such as overall pressure drop and heat flux. The consequences of specifying too high a coal concentration are believed to include apparent viscosity of the coal/slurry mixture and pressure drops so high that pumping is impossible, and heat transfer so poor that heat flux must be reduced and coil length increased in order to bring the slurry to reaction temperature. Further, the pseudo-plastic nature of the slurry suggests increasing shear rate of the fluid, by increasing velocity and decreasing tube diameter, or both, to decrease apparent viscosity. Poor heat transfer and thermal conductivity suggest increasing the surface area of the tube, for example by going to a finned cross section, and increasing turbulence. Increasing the quantity of gas introduced at the preheater inlet is generally believed to continuously increase heat transfer and overall pressure drop.

Applicants in designing the experiments which led to the present invention undertook to calculate predicted physical behavior of the slurry flowing through the preheater based on laboratory work and observations of prior researchers. Apparent viscosity of the gas/slurry mixture in the preheater was projected from laboratory viscosity measurements. In calculating the projected apparent viscosity of the flowing coal-oil slurry and gas mixture throughout the preheater the assumption was made that the fluid was non-Newtonian. The predicted apparent viscosity as a function of fluid temperature curve is shown as curve B of in FIG. 1. As illustrated in curve B FIG. 1 a rather sharp shoulder leading to a peak apparent viscosity in the neighborhood of 600° F. was expected. Then the apparent viscosity was expected to decrease rapidly with increasing temperature. Curve C of FIG. 1 shows viscosity of a solids free stream.

The predicted apparent viscosities as a function of temperature were then used to calculate pressure drops. In the predicted pressure drop calculations the further assumption was made that flow would be in the elongated bubble flow regime. Thermal conductivity, heat transfer, and fluid/skin temperature profiles were also predicted. Thermal conductivity of the slurry was predicted by extrapolating thermal conductivity of the liquid and solid components from those of similar hydrocarbons and then calculating a slurry thermal conductivity with the well known Tareef correlation. Thermal conductivity was expected to decrease continuously along the length of the coil. Heat transfer coefficients were related to viscosity and thermal conductivity through the Dittus-Boelter correlation with the Sieder-Tate viscosity correction. The heat transfer coefficients predicted at various temperatures are shown in FIG. 2. A curve of heat transfer was expected to be inversely related to the viscosity curve with heat transfer being lowest at a temperature near the temperature of peak viscosity. With the predicted heat transfer coefficients tube and fluid temperatures were projected. A representative profile of predicted skin/fluid temperatures is shown in FIG. 3.

SUMMARY OF THE INVENTION

The process of the present invention involves controllably heating in a flowing stream a coal-oil slurry and a gas containing at least about 70% by volume hydrogen in a heating zone while maintaining a gas to slurry volume ratio above a critical minimum and maintaining homogeneous flow in the portion of the heating zone where the temperature of the bulk fluid is raised from about 500° F. (260° C.) to about 600° F. (332° C.). Preferably homogeneous flow is maintained in the portion of the zone where the temperature of the bulk fluid is raised from about 450° F. (232° C.) to about 650° F. (343° C.). Most preferably homogeneous flow is maintained throughout the entire heating zone. In studies on coal-oil slurries applicants have found that the minimum critical gas holdup for any given slurry generally falls in the neighborhood of about 0.4. Although applicants have observed satisfactory operation with a minimum gas holdup of 0.37, a minimum gas holdup of at least 0.38 throughout the heating zone is preferred.

Applicants have unexpectedly found that control of the relative volume of slurry to gas in the heating zone allows stable operation over a broad range of coal/solvent ratios with acceptable pressure drops and heat transfer. Now any coal to solvent ratio may be used provided the gas/slurry volume ratio is adjusted to a level above a critical minimum. Large enough quantities of gas must be used to ensure sufficient gas volume in any given segment of the heater. The amount of gas flow required for a given slurry will depend upon many factors. In general as the amount of coal in the slurry increases the amount of gas flow required to ensure stable operation also increases. Use of high enough gas quantities to assure stable flow conditions permits operation with increased heat flux and decreased coil length. Now the advantages of a shorter coil and improved heating efficiency obtained with high heat fluxes can be weighed against the increased cost of operating at conditions required for adequate gas volume to assure stable operations.

Operation above a minimum gas holdup is desirable with any coil-oil slurry in order to enhance heat transfer through the slurry. Enhanced heat transfer avoids the rapid coking associated with poor heat transfer and therefore avoids frequent plugging of passageways. As a practical matter for all systems with low coal concentrations, that is a coal concentration less than 25% by weight, the volume of gas sufficient to give acceptable heat transfer will also be sufficient to give stable flow conditions.

Operation with a gas holdup above the critical minimum for any given system is important to stable flow conditions when the coal concentration reaches 25% by weight. When the gas to slurry volume ratio is lowered below the critical ratio changes in slurry behavior indicating unstable conditions have been observed.

The pressure drop through the coil suddenly and dramatically rises as the gas rate is decreased to the critical gas rate, and then with further decrease in gas rate the pressure drop suddenly decreases in some instances to almost a third of the original pressure drop. Thus, applicants have discovered, contrary to the teachings of basic engineering for simple two-phase flow, that the overall pressure drop does not continually increase with increasing amounts of gas in the stream. Rather, a curve of overall pressure drop as a function of gas to slurry volume ratio actually goes through a maximum as the gas fraction increases, in some cases very abruptly; then the overall pressure drop decreases and with further increases in gas rate begins to increase at a slower rate.

As the gas flow rate is dropped to the critical minimum and lower rates, thermal instability is also observed. The temperature differences between the tube skin and the fluid become large. Temperature control of the preheater becomes difficult as the temperatures of both the skin and fluid show wild oscillations. The slurry temperature at the heater outlet sometimes registers a lower value than the last fluid temperature measurement inside the furnace.

Applicants have also discovered that the viscosity of the coal-oil slurry flowing through a preheater coil is high over a broader temperature range than previously believed. Applicants have observed much higher pressure drops per unit length of the coil than was expected.

Contrary to the teachings of the prior art, applicants have discovered that heat transfer is best for a gas saturated slurry flowing in laminar flow (mixture Reynolds number less than about 1000) over the temperature range where it was previously thought to be worst. With a gas saturated slurry made from recycle liquefaction slurry and bituminous coal the heat transfer is best in the temperature range from 450° F. (232° C.) to 650° F. (343° C.) while the stream flows in laminar flow.

Applicants have further discovered that coal-oil slurries at the temperatures and pressures encountered in preheaters and at shear rates in excess of 150 $sec^{-1}$ behave essentially as Newtonian fluids.

Finally, applicants have discovered that temperature differences between the skin and fluid dramatically increase during brief coal outage periods as the coal concentration in the feed slurry drops. In some cases the temperature differences between the tube skin and the fluid actually doubled and tripled. This observation is completely contrary to the teachings of the prior art that an increase in coal concentration decreases heat transfer.

The coal-oil slurry for use in the present invention may be prepared from any coal dissolving liquid and any swelling coal. Swelling coals are those which absorb solvent in a slurry and thereby swell causing the apparent viscosity of the slurry to increase. Different coals swell to different degrees depending upon their reactivity with coal dissolving solvents. Examples of very reactive swelling coals include, among others, bituminous coals such as Pittsburgh seam coals, Illinois coals, and Kentucky coals. Examples of less reactive swelling coals include sub-bituminous coals such as Belle Ayre coal, Big Horn coal, and Wyodak coal. Examples of other less reactive swelling coals are lignites such as Baukol-Noonan, and Beulah. The solvent used to make the coal-oil slurry may be any liquid in which coal is soluble at elevated temperatures. Coal dissolving liquids are typically derived from coal itself and are typically aromatic. As used throughout the specification and claims the term "coal-oil slurry" is intended to mean a slurry made from any swelling coal and any coal dissolving liquid.

The gas used in the present invention should contain at least about 70 mol percent hydrogen. Hydrogen should be used for two reasons. First coal solvation involves formation of free radicals which are stabilized by hydrogen. A portion of the hydrogen gas introduced at the inlet to the preheater is ultimately consumed either to replenish hydrogen stripped from solvent or to actually stabilize coal free radicals. Another reason for using hydrogen is its high thermal conductivity. Of common gases only deuterium, helium and neon have thermal conductivities of the same order of magnitude as hydrogen and even those gases have thermal conductivities far lower than hydrogen. Oxygen should be avoided.

The coal-oil slurry flows through a heating zone co-currently with a gas containing at least about 70 mol percent hydrogen in a manner controlled to give a gas to slurry volume ratio above the critical minimum. The shape and configuration of the heating zone is generally not critical to the invention. Applicants prefer a tubular coil with a circular cross section arranged in a race track configuration. The coil is then preferably heated in a fired box. Wherever the terms "preheater" or "coil" are used throughout the specification applicants intend to describe the preferred tubular coil in a fire box.

Preferably the flow of the stream is controlled to give a gas to slurry volume ratio above the critical minimum by adjusting the superficial velocity of the gas at the inlet to the coil. Thus, applicants prefer to operate with a gas flow rate high enough to assure sufficient gas volume in those sections of the coil where the changing chemical and physical characteristics of the flowing stream result in a low gas volume. Other methods of controlling the relative volume of gas to slurry at any given segment in the coil include adjusting those system parameters which would affect superficial velocity of the gas and slurry. One such method would be injection of additional hydrogen at different points along the coil so as to increase the superficial velocity of the gas.

The exact value of the critical minimum gas to slurry volume ratio for any given system will depend on numerous factors which affect the composition of the gas/slurry stream and its flow through the preheater. Operationally, the critical gas to slurry volume ratio can be found by decreasing gas flow rate to the point where flow instability is observed. The symptoms of flow instability include a rapid increase and then decrease in overall pressure drop with small variation in gas flow, dramatic increase in the difference between skin and fluid temperatures, erratic oscillations of both skin and fluid temperatures, and a decrease in fluid temperature at the heater outlet over the highest temperature recorded near the end of the coil. At least one and usually all four of these symptoms of flow instability have been observed on each occasion where the gas flow rate was decreased too far. Applicants prefer to operate at the gas flow rate somewhat above the critical minimum flow rate where the overall pressure drop for the system is lowest. Thus, applicants prefer to minimize pressure drop while always maintaining the gas flow rate above the critical minimum.

The critical minimum gas to slurry volume ratio may be conveniently expressed in terms of gas holdup in any given segment of the preheater. Throughout the specification and claims the term "gas holdup" is meant to describe the volume fraction of gas in any given segment of the preheater.

Many models have been developed to correlate physical-chemical characteristics of two-phase flow with observed fluid dynamic behavior. Applicants have studied application of the Hughmark correlation to coal-oil slurries flowing in the presence of gas. The Hughmark correlation has consistently correlated the flow characteristics of the slurry stream over a broad range of operating conditions. Because of their experience with the Hughmark correlation applicants prefer its use. However, any model which consistently correlates the properties of the stream with the fluid behavior over a variety of conditions can be used to predict gas holdup. Applicants believe that correlations such as those proposed by Lockhart and Martinelli, by Baker, by Hoogendoorn and Buitelaar, by Eaton, and by Bankoff could be used satisfactorily.

The Hughmark correlation relates the volume fraction of gas to the gas/slurry superficial velocity ratio through a flow parameter $K_b$. The Hughmark correlation can be expressed as:

$$\epsilon_g = K_b\left(\frac{U_g}{U_g + U_s}\right)$$

where $\epsilon$=gas holdup $U_g$=the superficial velocity of the gas at the inlet to the preheater $U_s$=the superficial velocity of the slurry at the inlet to the preheater and $K_b$=the flow parameter of Hughmark.

The Hughmark flow parameter is a function of the mixture Reynolds number, the mixture Froude number, and the volume fraction of the slurry at the inlet of the preheater. Gas holdup for any given segment can be calculated using the Hughmark correlation with knowledge of the coil's diameter, the mass flow rate of the total mixture, the viscosity of the gas in that segment, the apparent viscosity of the gas saturated slurry in that segment, and the superficial velocities of the gas and slurry at the inlet to the preheater. The apparent viscosity of the gas saturated slurry at any given point along the coil can in turn can be calculated from pressure drop profiles.

The maximum and minimum gas flow rates for any given slurry flow rate are those flow rates at which the flow regime in the segment under consideration goes from homogeneous to nonhomogeneous. "Homogeneous" flow is intended to describe all flow regimes wherein the three phases—gas, liquid and solid—are intimately admixed. Examples of homogeneous flow include dispersed flow, bubble flow, dispersed bubble, an elongated bubble. Examples of nonhomogeneous flow include stratified flow, slugging flow, and plug flow. Elongated bubble and bubble flow have been observed when the gas holdup is maintined in the preferred range between 0.38 and 0.6.

Use of a minimum gas holdup to stabilize heat transfer and pumping of a coal-oil slurry is particularly useful in coal liquefaction processes. In modern coal liquefaction processes any coal dissolving solvent may be used. Typically, the coal dissolving solvent will be a recycle distillate or a recycle slurry prepared from previous operation of a coal liquefaction process. Applicants prefer a recycled liquefaction slurry. The preferred coal-oil slurry is prepared with a recycle slurry having a minimum boiling point of about 380° F. (193° C.) and with a swelling bituminous coal. In a coal liquefaction system a previously heated feed slurry containing at least about 25% by weight total solids is allowed to react in a zone, which is often called the dissolver, with a hydrogen containing gas at temperatures ranging from about 700° F. (371° C.) to about 870° F. (466° C.) and hydrogen partial pressures ranging from about 1,000 to 4,000 lb/in$^2$ (690 to 2,760 newton/cm$^2$) for hydrogenation and hydrocracking. All of the hydrogen reacted with the coal-oil slurry may be heated with the slurry or a portion of it may be heated separately. Operation with a coal concentration ranging between about 25 and 35% by weight and with a total solids concentration up to about 50% by weight is preferred. The preferred temperature range in the dissolver is about 750° F. (399° C.) to 860° F. (460° C.); the preferred hydrogen partial pressures are from 1,000 to 2,500 lb/in$^2$ (690 to 1,725 newton/cm$^2$).

In such a liquefaction process the preheating process includes introducing the slurry to a preheater at a superficial slurry velocity between about 1.5 ft/sec (0.46 m/sec) and 15 ft/sec (4.6 m/sec) and an inlet temperature between about 250° F. (121° C.) and 400° F. (204° C.). The slurry can conveniently be fed to the preheater at a superficial slurry velocity between about 4 ft/sec (1.2 m/sec) and 10 ft/sec (3 m/sec); the most preferred superficial slurry velocity is about 6 ft/sec (1.8 m/sec). A gas containing at least about 70 mol percent hydrogen is simultaneously introduced to the preheater at a superficial gas velocity between about 1 ft/sec (0.3 m/sec) and 30 ft/sec (9 m/sec) with a hydrogen partial pressure ranging from about 1,000 to 4000 lb/in$^2$ (690 to 2,760 newton/cm$^2$). The gas can conveniently be introduced at a superficial gas velocity ranging between about 10 ft/sec (3 m/sec) and 15 ft/sec (4.6 m/sec) and hydrogen partial pressures between about 1,000 and 2,500 lb/in$^2$ (1,035 to 1,725 newton/cm$^2$). Most preferably, the hydrogen containing gas is introduced at a superficial gas velocity of approximately 12 ft/sec (3.7 m/sec). The velocity of the gas is controlled such that the ratio of the average actual volume of gas to the average actual volume of slurry at the preheater inlet is at least 1.0 and such that the slurry/gas stream maintains a homogeneous flow throughout the length of the preheater coil where the bulk of the slurry is heated from about 500° F. (260° C.) to about 600° F. (332° C.). The slurry/gas stream can then be heated to the desired temperature for introduction into the reaction zone.

Preferably homogeneous flow is maintained while the slurry is heated from about 450° F. (232° C.) to about 650° F. (343° C.). Most preferably homogeneous flow is maintained throughout the entire preheater. Applicants also prefer a minimum gas to slurry volume ratio at the inlet of about 2 to 1.

Further system efficiency may be achieved in the present invention by controlling the flow rate of the gas/slurry mixture so as to assure a residence time of at least 1.5 minutes after the slurry has been heated to 450° F. (232° C.). The apparent viscosity of the gas saturated slurry at any given temperature above about 600° F. (316° C.) markedly decreases in runs where the slurry remains in the preheater at least 1.5 minutes after it reaches the temperature of 450° F. (232° C.). This change in the fluids' behavior is believed to depend upon a spacetime and temperature dependent chemical reaction wherein the space-time dependency controls. The entire process efficiency is improved by this residence time because virtually complete solvation of the coal takes place. Thus, the stream entering the dissolver has a lower apparent viscosity. As those skilled in the art will appreciate this lower apparent viscosity of the stream entering the dissolver affects the mixing and therefore the reactions and kinetics of reactions taking place in the dissolver.

Further heat transfer efficiency, and therefore overall process efficiency, may be achieved by using multiple heating zones. Applicants have discovered that the apparent viscosities of the gas saturated slurry are such that operation with appropriate mass flow rates for the tube inside diameter results in slurry Reynolds numbers less than 1,000 for a major portion of the coil. Thus, applicants believe the gas saturated slurry flows in laminar flow with additional gas dispersed throughout the gas saturated slurry as bubbles or elongated bubbles. In such a flow regime the primary mechanism of heat transfer through the fluid is conduction. Applicants have further discovered that the thermal conductivity of the gas saturated slurry goes through a maximum when the bulk temperature of the gas saturated slurry falls between 450° F. (252° C.) and 650° F. (343° C.). Thus heat transfer coefficients of the gas saturated coal-oil slurries vary as the slurries heat up and undergo chemical reactions. By using multiple heating zones the heat flux of each individual zone may be adjusted to maximize heat transfer for the slurry in a particular temperature range without undue coking. In this way a greater heat flux can be achieved where the heat transfer coefficient is greater.

Still further system efficiency can be achieved by operating with a slurry shear rate in the range from 150 sec$^{-1}$ to 350 sec$^{-1}$. No beneficial decrease in slurry apparent viscosity is achieved at shear rates significantly above 150 sec$^{-1}$ because the slurry at the temperatures and pressures encountered in the preheater behaves essentially as a Newtonian fluid.

As mentioned before, the exact value of the minimum critical gas flow rate will vary for different systems. The degree of instability observed at gas rates immediately below the minimum gas rate also varies for different systems. Factors which influence the onset and severity of unstable operation include among many others: composition of solvent, concentration of coal, type of coal, particle size distribution of coal, total solids in the feed, slurry feed rate, the time and temperature history of the slurry before its introduction into the heater, and heat flux. In general, those factors which increase the initial apparent viscosity and density of the gas saturated slurry require more gas per unit volume of slurry. In cases of lower coal concentration, larger coal particle size, and lower total solids concentration the transition into unstable flow is not as sharp as with high concentrations of coal and total solids and small particle size. Similarly, a slurry made with a less reactive coal that swells to a less degree than another will display a less severe transition at a lower gas rate into unstable flow than a slurry with a more reactive coal that swells to a greater degree. Slurries rich in low boiling, less dense oils will display a less sharp transition at lower gas flow rates than those rich in high boiling dense oils.

In designing a commercial coal liquefaction plant flexibility for variations in feedstock will be desirable. One embodiment of the present invention will be particularly useful when variations in feedstocks are encountered. for example a plant may operate for a period of time with a Pittsburgh seam coal and then shift to an Illinois coal. For a given slurry flow rate the minimum critical gas rate and the optimum gas flow rate will vary depending on the coal. Similarly upsets in the mix tank or brief coal outages can result in variations in coal concentration. By continuously adjusting the gas flow rate to maintain a minimum holdup in the vicinity of 0.4 the coal liquefaction system can be operated continuously notwithstanding upsets in stream composition or changeovers to streams of different compositions.

With the aid of a computer the apparent viscosity of the gas saturated slurry in given increments along the length of the coil can be conveniently determined. The apparent viscosity of the gas saturated flurry in each increment can then be used to calculate for each increment theoretical maximum and minimum superficial inlet gas velocities which would result in a gas holdup in each respective segment at least as great as the design minimum gas holdup and no greater than the design maximum gas holdup. Then, if necessary, the superficial gas velocity at the preheater inlet can be increased or decreased to a rate at least as great as the largest minimum theoretical superficial gas velocity and no greater than the smallest theoretical superficial gas velocity. This adjustment process can then be repeated periodically to assure that optimum conditions are maintained.

The question of exactly why coal oil slurries display unstable behavior at certain gas rates cannot be explained with certainty until the chemistry of reactions occurring in preheaters is understood. Without intending to limit the scope of the present invention applicants offer the following explanation as their best understanding of the mass and heat transfer phenomena occurring in the preheater.

The gas in the preheater apparently performs both mixing and heat transfer functions. At low gas rates the available gas apparently cannot provide adequate mixing energy for efficient heat transfer from the wall of the preheater to the expanding gel slurry. As a result of inadequate mixing and inefficient heat transfer, coal solvation reactions slow down, apparent viscosity remains high, and pressure drop increases. Also as a result of poor heat transfer, skin temperatures rise and a distinct liquid boundary layer may develop at the wall. Heat from the skin then must pass through a less conductive liquid layer rather than a gas saturated gel with high thermal conductivity. Consequently, the skin temperatures further increase, the temperature of the liquid layer at the wall further increases with resulting decrease in apparent viscosity of this layer. Thus, the gel in the center may ride on a smooth liquid boundary layer without excessive frictional losses.

Mass transfer between gas and gel may be so poor that slug flow of distinctly different gas and gel phases may result. A slug flow regime may explain the observation during experiments of lower temperature measurements at the preheater outlet than at the last fluid temperature reading inside the firebox. The frequency of gas slugs in the coil may have coincided with the frequency of reading temperature close to the end of the coil. Thus since the thermowell may have been exposed to gas the temperature response may have been incorrect. With a different size coil the frequency of gas slugs should change so that the frequency of temperature readings would not necessarily coincide with exposure to gas rather than slurry. In fact when a different size coil was tested the lower fluid temperature at the coil outlet was not observed as frequently.

Alternatively the irregular flow regime may have resulted in a situation where the thermowell was exposed to gas for longer average time periods than to slurry. In this situation again the thermowell would not accurately reflect the true average temperature in the segment.

Inadequate mass and heat transfer may also result from too much gas flow. If the ratio of gas to slurry volume is increased beyond a maximum value the flow pattern could again shift into an undesirable slugging region. Thus, for smooth, stable and efficient operation of the preheater the gas flow rate should preferably be adjusted to achieve the minimum gas volume required for stable flow and kept below the level at which the gas and liquid phases begin to separate into slugging or intermittent flow. As mentioned before, although stable operation has been observed with a gas holdup as low as 0.37, a minimum holdup of 0.38 is preferred. Similarly, although dispersed flow has been observed at low slurry feed rates with a gas holdup as high as 0.72, applicants prefer to operate with a gas holdup less than 0.6.

Applicants believe that operation with a gas holdup above the critical minimum results in a gas saturated slurry which follows a laminar flow regime during the time period when the apparent viscosity of the gas saturated slurry is very high. Typically, this peak in apparent viscosity of the gas saturated slurry occurs in the bulk fluid range of about 450° F. (232° C.) to about 650° F. (343° C.). While this gas saturated gel moves through the coil in a laminar flow regime the primary vehicle of heat transfer is conduction. For this reason the very unexpected peak in thermal conductivity of the gas saturated slurry in the temperature range of about 450° F. (232° C.) to about 650° F. (343° C.) permits operation with increased heat flux over that temperature range.

Once the slurry starts to break down into less viscous asphaltenes and oils the apparent viscosity of the gas slurry stream decreases. As the viscosity of the stream decreases the mixture Reynolds number increases to the point where flow probably shifts to a turbulent flow regime. In a turbulent flow regime the primary mechanism of heat transfer is convection. Applicants believe the flow regime usually becomes fully turbulent by the time the fluid reaches a temperature of about 700° F. (371° C.).

Once the gas to slurry volume ratios have been adjusted to enable stable operation further efficiency may be achieved by allowing time for complete solvation of the coal. Under conditions where the phenomena in the preheater are not limited by heat and mass transfer, i.e. where the gas flow is high enough, the complex changes in the coal oil slurry are dictated by chemical reactions and their kinetics. The high apparent viscosity of coal-oil slurries is generally thought to be related to the preasphaltene content of the slurry, preasphaltenes being the primary products of the initial coal-oil reactions. Thus, a correlation should exist between the observed physical properties and the reaction kinetics: space-time, temperature, and any activation energies for formation or exhaustion of preasphaltenes. Although the reactions and their kinetics are not well established, recent work suggests that preasphaltene formation is a zero order reaction whereas the reactions by which preasphaltenes are consumed follow first order kinetics. Further, applicants have now discovered that the residence time effect dominates the temperature effect in the latter reaction.

DETAILED DESCRIPTION

The present invention will be useful in any system where a coal-oil slurry stream is heated. However, since the invention was discovered in the context of a coal liquefaction system and applicants prefer its use in a liquefaction system, the detailed description of the invention will directed to that particular embodiment.

Figure 1:
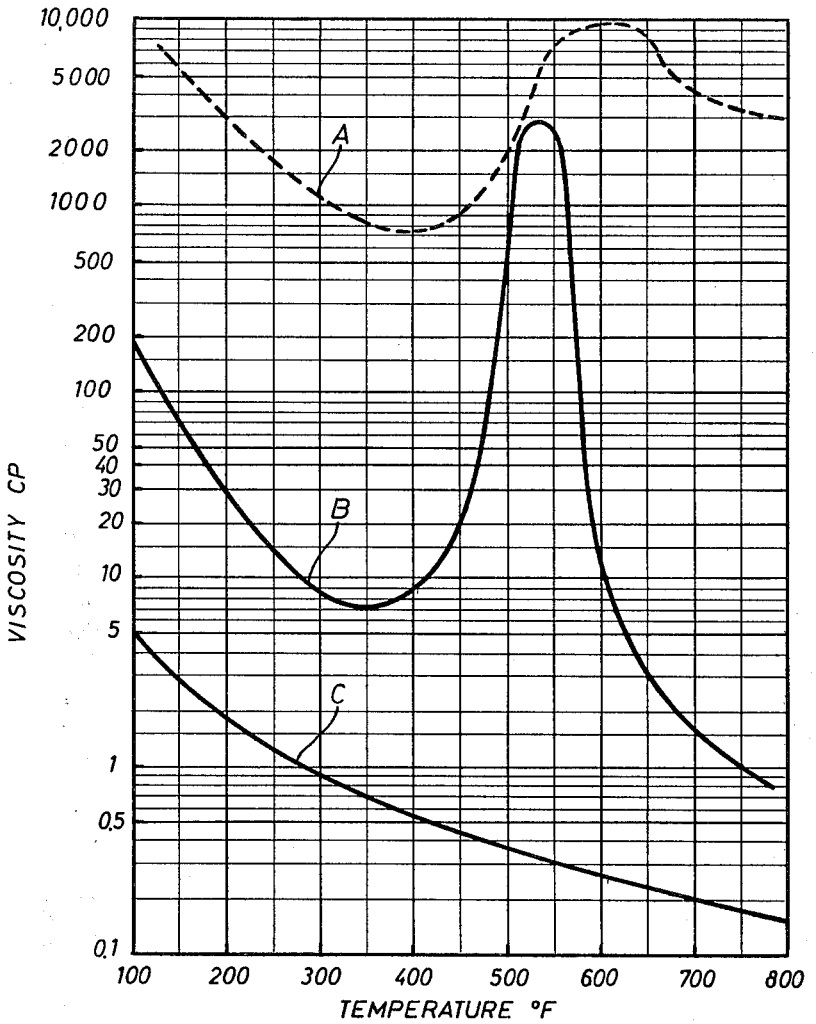
FIG. 1 is several graphs of coil-oil slurry viscosity as a function of temperature as reported by researchers and predicted by applicants in preparation for the experiments which led to the present invention.
Figure 3:
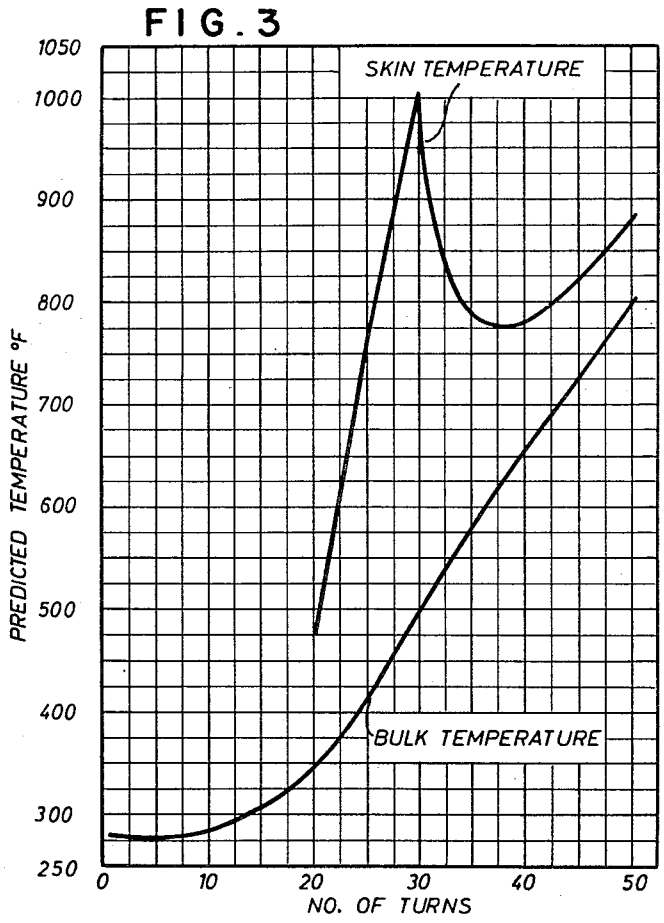
FIG. 3 is a graph of the tube skin and bulk fluid temperature profiles which applicants predicted in preparation for the experiments which led to the present invention.
Figure 2:
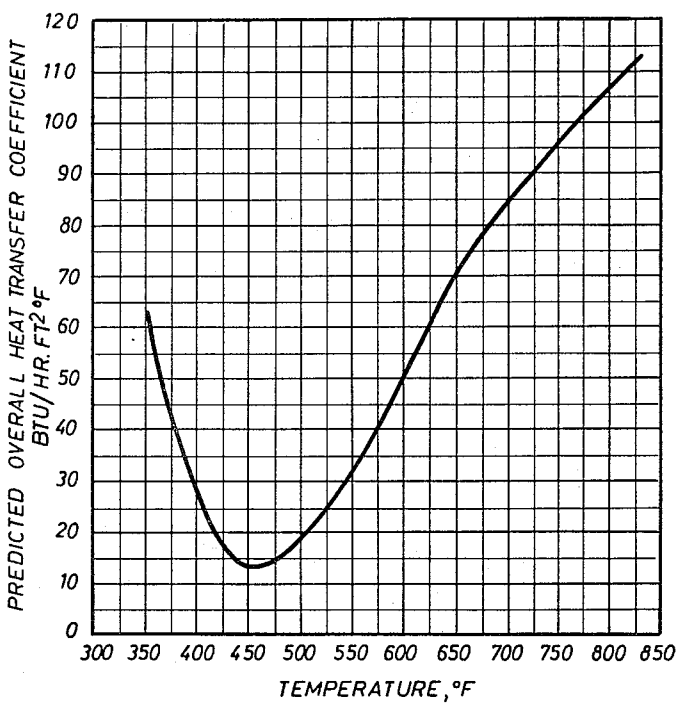
FIG. 2 is a graph of predicted overall heat transfer coefficient as a function of temperature developed by applicants in preparation for the experiments which led to the present invention.
Figure 4:
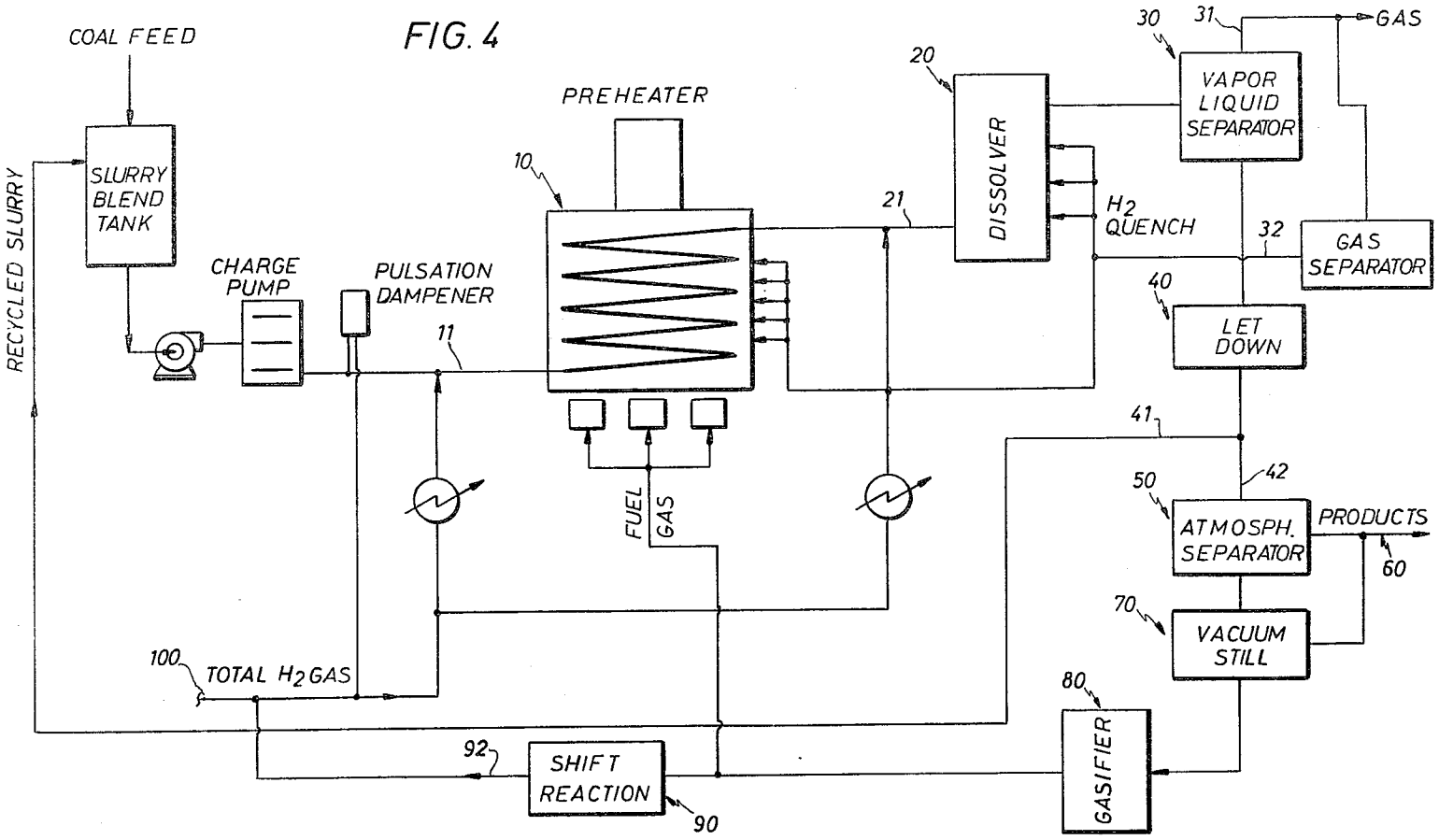
FIG. 4 is a schematic diagram of a SRC II coal liquefaction process.

U.S. Pat. No. 4,159,238 issued to Gulf Oil Corporation, as assignee of the inventor Schmid, on June 26, 1979 describes an integrated coal liquefaction gasification system. In that system, as schematically shown in FIG. 4, a coal-oil slurry is charged to a preheater 10 where it is heated to a reaction temperature in the range of 680° to 870° F. (360° to 446° C.), preferably about 700° to 760° F. (371° to 404° C.). From the preheater 10 the slurry goes directly into a dissolver 20 where heat released by exothermic hydrogenation and hydrocracking reactions raises the temperature to the range of 800° to 900° F. (427° to 482° C.), preferably 840° to 870° F. (449° to 466° C.).

From the dissolver 20 the reaction stream goes to a vapor/liquid separation system 30. The hot overhead vapors are removed via line 31 for cooling and further separation. Ultimately a part of this stream is separated from other parts as purified hydrogen and is recycled via line 32 in the process. The slurry from the vapor/liquid separators 30 is let down 40 to atmospheric pressure and then split into two streams. One stream 41 is recycled as solvent for the process. The other stream 42 is sent to an atmospheric fractionator 50 for separation of the major products 60 of the process. The bottoms from the atmospheric separator 50 are further distilled in a vacuum distillation tower 70. The vacuum tower bottoms are then fed to a gasifier 80 where synthesis gas is produced. A portion of the synthesis gas is passed to a shift reactor zone 90 for conversion into molecular hydrogen and carbon monoxide. The hydrogen and carbon monoxide stream is then scrubbed in an acid gas removal zone to remove $H_2S$ and $CO_2$. The purified hydrogen obtained (85 to 100% pure) is then compressed to process pressures and used as makeup hydrogen 92 in the preheater 10.

The preferred process described in the Schmid patent contemplates addition of substantially all of the reaction hydrogen at the inlet 11 to the preheater 10. The source of this hydrogen could be makeup hydrogen from the gasifier 80 and shift reactor 90, recycle, or both. Any further hydrogen added to the system is preferably added as quench 21 to the dissolver 20 to control the reaction temperature and alleviate the impact of the exothermic reactions taking place in the dissolver 20. Again the source of this hydrogen could be makeup hydrogen, recycle hydrogen 32 or both. In the present invention it will be beneficial to design the process so that hydrogen required to sustain hydrogenation and hydrocracking can be introduced both at the inlet 11 to the preheater 10 and downstream of preheating at the inlet 21 to the dissolver 20. With this design it will be possible to vary the amount of gas going into the preheater in order to optimize mass and heat transfer. Remaining amounts of hydrogen required for the hydrogenation and hydrocracking reactions in the dissolver 20 may then be added at the dissolver inlet 21. Thus, the total amount hydrogen containing gas fed to the dissolver can be kept constant while the amount of hydrogen containing gas introduced at the inlet to the preheater is adjusted to an optimum level. Additional hydrogen added at the inlet 21 to the dissolver can be recycle hydrogen and if the amount of recycle hydrogen is insufficient makeup hydrogen 92 from the gasifier 80 and shift reactor 90 can be used. Alternatively the hydrogen requirements for the system may be met from any other source 100.

The exact size and configuration of the heater apparatus in which the process of the present invention can be performed will vary according to the system into which a heater is incorporated. In a coal liquefaction system as described in the Schmid patent the function of the preheater is to elevate the temperature of the coal-oil slurry to the inlet conditions of the dissolver. Thus, design specifications such as mass throughput and inlet and outlet temperatures are determined by the needs of the overall system. For purposes of illustration the design of a preheater to process 6,000 tons per day (5,455 metric tons/day) of coal in a slurry containing 30% by weight coal will be explained. The design basis for such a system is summarized in Table I.

TABLE I

DESIGN BASIS[a]
Six Thousand Tons of Coal
Per Day Coal-Oil Slurry Preheater
(5,455 metric tons per day)

| | | |
|---|---|---|
| Slurry Feed Rate lb/hr (kg/hr) | 1,666,667 | (757,576) |
| Composition (Wt %) | | |
| Coal | 30.0 | |
| Total Solids | 45.0 | |
| Preheater Hydrogen[b] lb/hr (kg/hr) | 39,102 | (17,774) |
| Composition: (Mole %) | | |
| $H_2$ | 96.87 | |
| $C_1$ | 0.45 | |
| CO | 1.68 | |
| $CO_2$ | 0.26 | |
| $N_2$ | 0.50 | |
| Ar | 0.15 | |
| Others ($H_2O$, $H_2S$) | 0.09 | |
| Absorbed Heat Duty MMBTU/Hr (MM Kcal/hr) | 385[c] | (97) |
| Flow Regime | Homogeneous | |
| Minimum Gas Holdup | 0.38 | |
| Minimum Slurry Residence Time Minutes | 1.5 | |
| Maximum Superficial Slurry Velocity Ft/Sec (M/sec) | 10 | (3) |
| Maximum Inside Film Temperature °F., (°C.) | 925 | (496) |
| Preheater Inlet Temperature °F. (°C.) | 383 | (195) |
| Preheater Outlet Temperature °F. (°C.) | 746 | (397) |
| Maximum Heater Pressure Drop lb/in$^2$ (Newton/cm$^2$) | 600 | (414) |

[a]Unless otherwise indicated the figures are averages.
[b]Design considerations for the overall liquefaction process suggest introduction of makeup hydrogen from the gasifier at the inlet to the preheater and recycle hydrogen at the inlet to the dissolver. Preheater hydrogen through the heater is variable in order to meet the other preheater design specifications such as minimum gas holdup and maximum film temperature.
[c]Based on 100% preheater hydrogen.

The first step in designing a preheater for such a process requires characterization of the physical properties of the gas and the coal-oil slurry as they flow through a preheater coil. Relationships which must be defined include: feed stream enthalpy as a function of temperature, weight percent vapor as a function of temperature, gas saturated slurry apparent viscosity as a function of temperature, gas saturated slurry thermal conductivity as a function of temperature, slurry density as a function of temperature, slurry heat capacity as a function of temperature, vapor molecular weight as a function of temperature, vapor heat capacity as a function of temperature, vapor viscosity as a function of temperature, and vapor thermal conductivity as a function of temperature. Representative curves of those relationships for the design basis in Table I are shown in FIGS. 5–14.

Certain of these relationships may be readily defined by reference to commonly available publications. Others to the extent they are not available in publications may be determined from routine laboratory experimentation. Thus, feed stream enthalpy, FIG. 8, weight percent vapor, FIG. 9, and vapor molecular weight, FIG. 10, can all be calculated.

Figure 6:
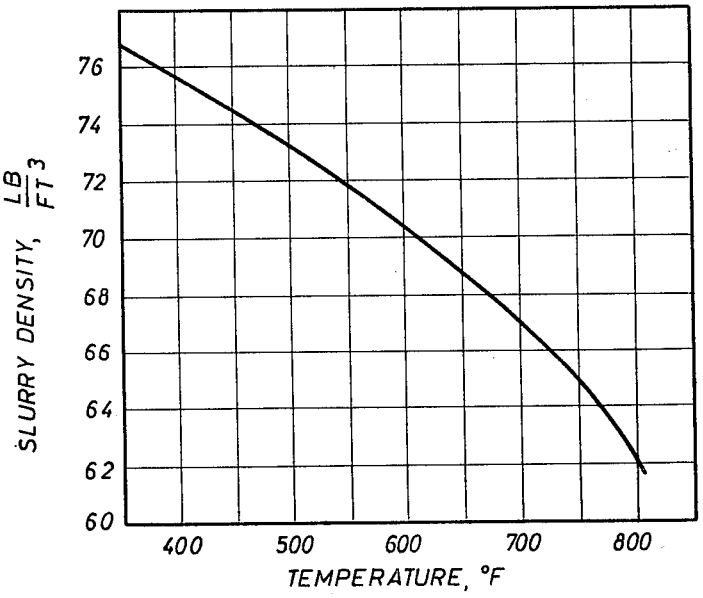
FIG. 6 is a graph of coal-oil slurry density as a function of temperature for a representative coal-oil slurry.
Figure 7:
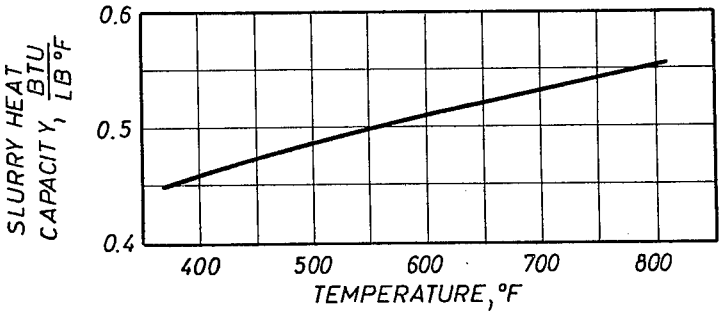
FIG. 7 is a graph of coal-oil slurry heat capacity as a function of temperature for a representative coal-oil slurry.
Figure 8:
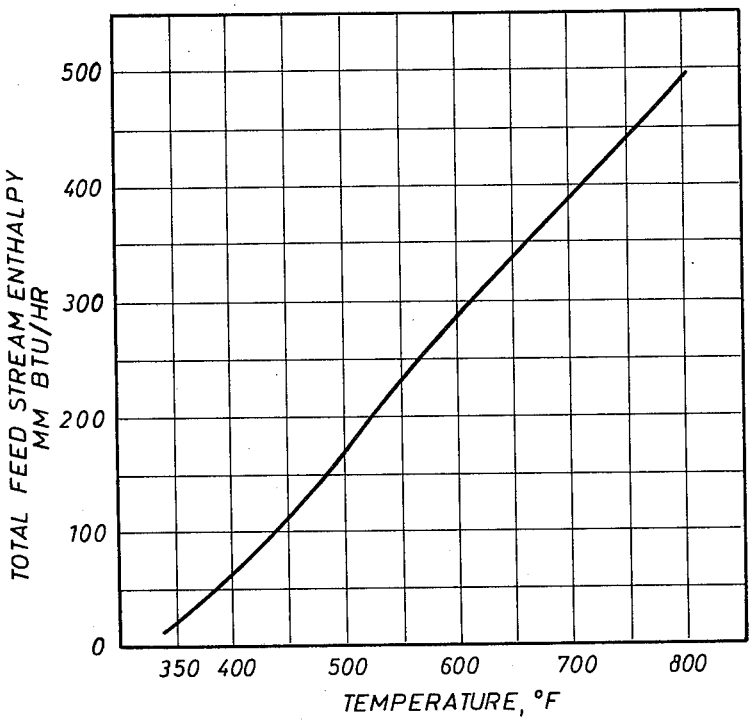
FIG. 8 is a graph of a coal-oil slurry and hydrogen containing gas feed stream enthalpy as a function of temperature for a representative coal-oil slurry and hydrogen containing gas feed stream.
Figure 9:
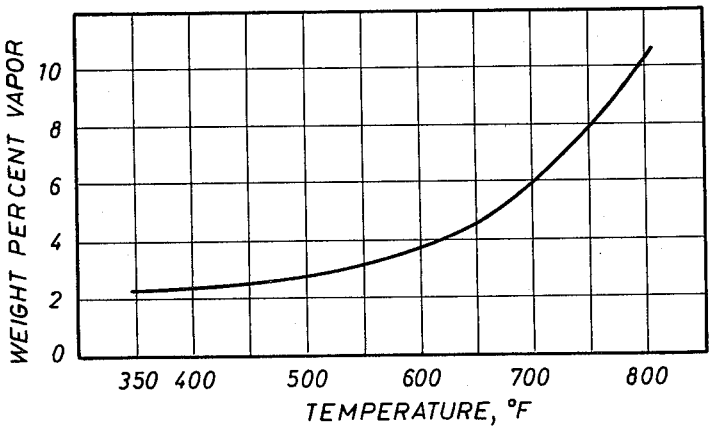
FIG. 9 is a graph of weight percent vapor as a function of temperature for a representative coal-oil slurry and hydrogen containing gas feed stream.
Figure 10:
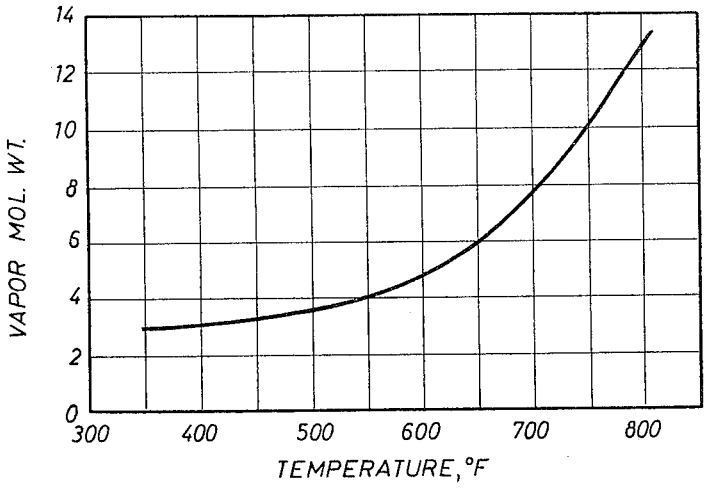
FIG. 10 is a graph of vapor molecular weight as a function of temperature for a representative coal-oil slurry and hydrogen containing gas feed stream.
Figure 11:
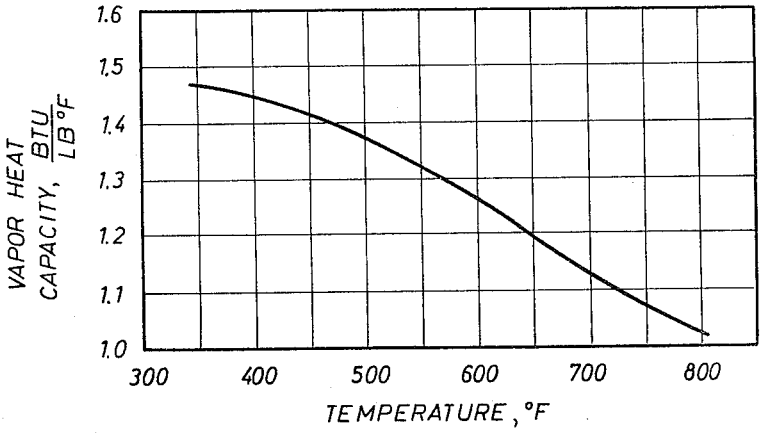
FIG. 11 is a graph of vapor heat capacity as a function of temperature for a representative coal-oil slurry and hydrogen containing gas feed stream.
Figure 12:
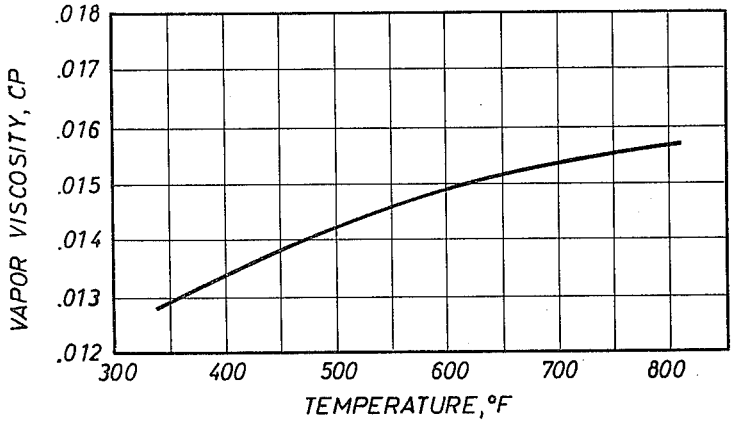
FIG. 12 is a graph of vapor viscosity as a function of temperature for a representative coal-oil slurry and hydrogen containing gas feed stream.
Figure 13:
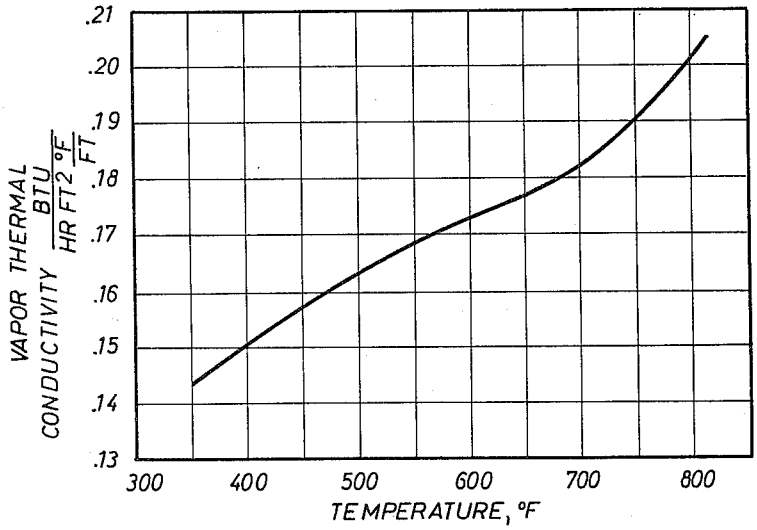
FIG. 13 is a graph of vapor thermal conductivity as a function of temperature for a repesentative coal-oil slurry and hydrogen containing gas feed stream.

Slurry density, FIG. 6, can be extrapolated for design purposes as a summation of the weighted densities of the various components in the inlet stream. Heat capacities of the slurry and vapor, FIGS. 7 and 11, and other properties of the vapor, FIGS. 12 and 13, to the extent they are not available in publications may be obtained in the laboratory.

Figure 5:
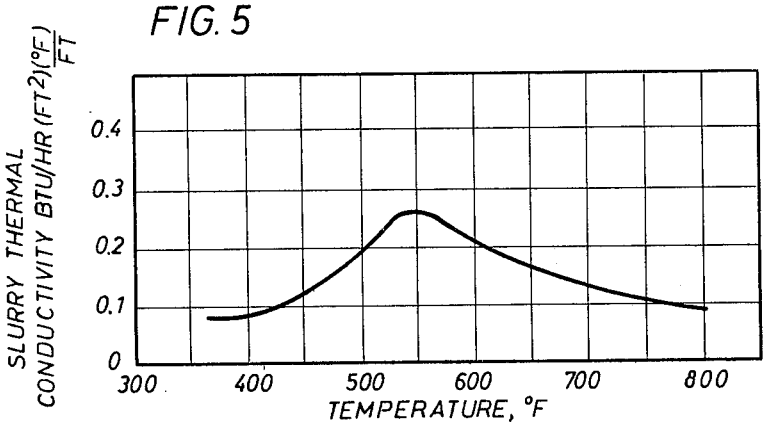
FIG. 5 is a graph of coil-oil slurry thermal conductivity as a function of temperature for a representative coil-oil slurry.
Figure 14:
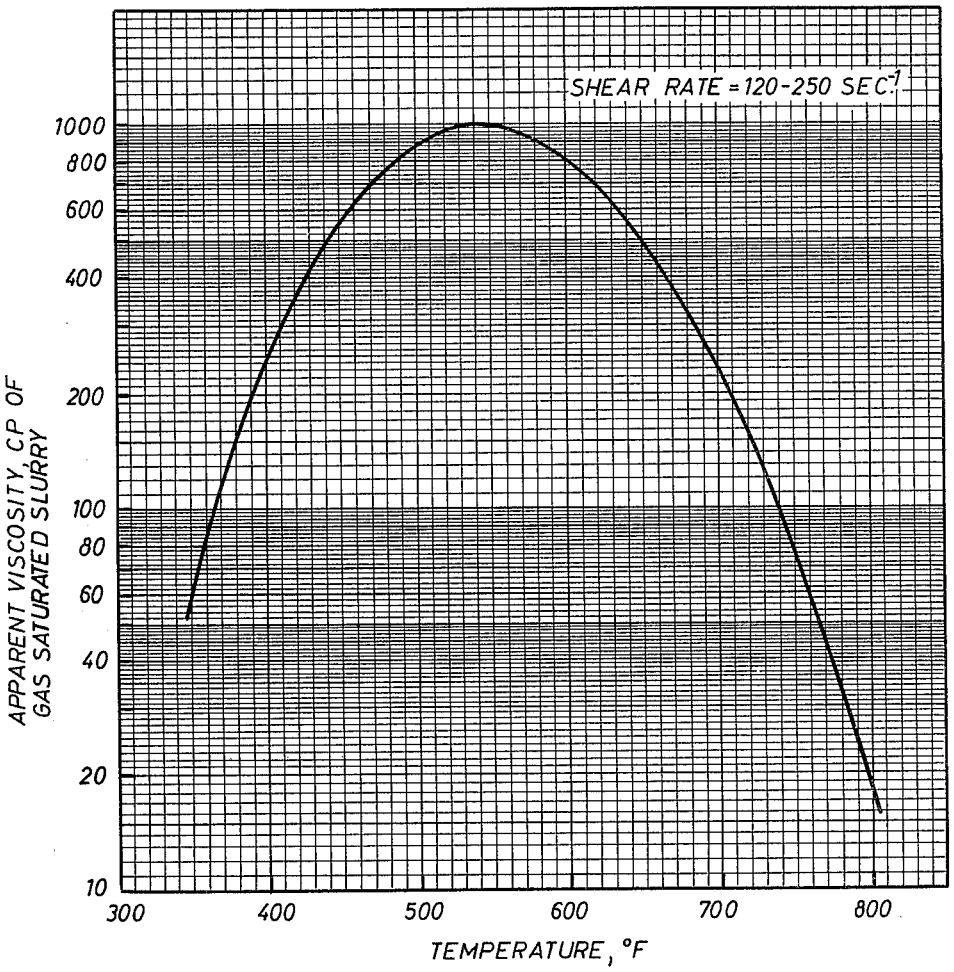
FIG. 14 is a graph of apparent viscosity of a gas saturated coal-oil slurry as a function of temperature for a representative coal-oil slurry and hydrogen containing gas stream.

Apparent viscosity of the gas saturated slurry, FIG. 14, heat transfer coefficient, and thermal conductivity, FIG. 5, which are crucially important to design and operation of the preheater will vary throughout the preheater coil as the composition of the slurry changes. Ongoing research directed towards characterizing the composition of coal-oil slurries as they are heated has not progressed sufficiently to make direct information on apparent viscosities, heat transfer coefficients, and thermal conductivities available. Once the composition of representative coal-oil slurries are known as a function of temperature it will be possible to determine apparent viscosity, heat transfer, and thermal conductivity either directly or with well-known correlations. At present however, the physiochemical characterization of the three-phase mixture as it undergoes complex changes through the preheater can be obtained only indirectly by measurement of pressure drop and fluid/skin temperatures along the length of an experimental coil. Further, apparent slurry viscosity and slurry thermal conductivity defined as a function of temperature from an experimental coil will be useful for scale up only when the design criteria for flow regime, gas holdup, and slurry residence time have been met in the experimental coil.

Figure 15:
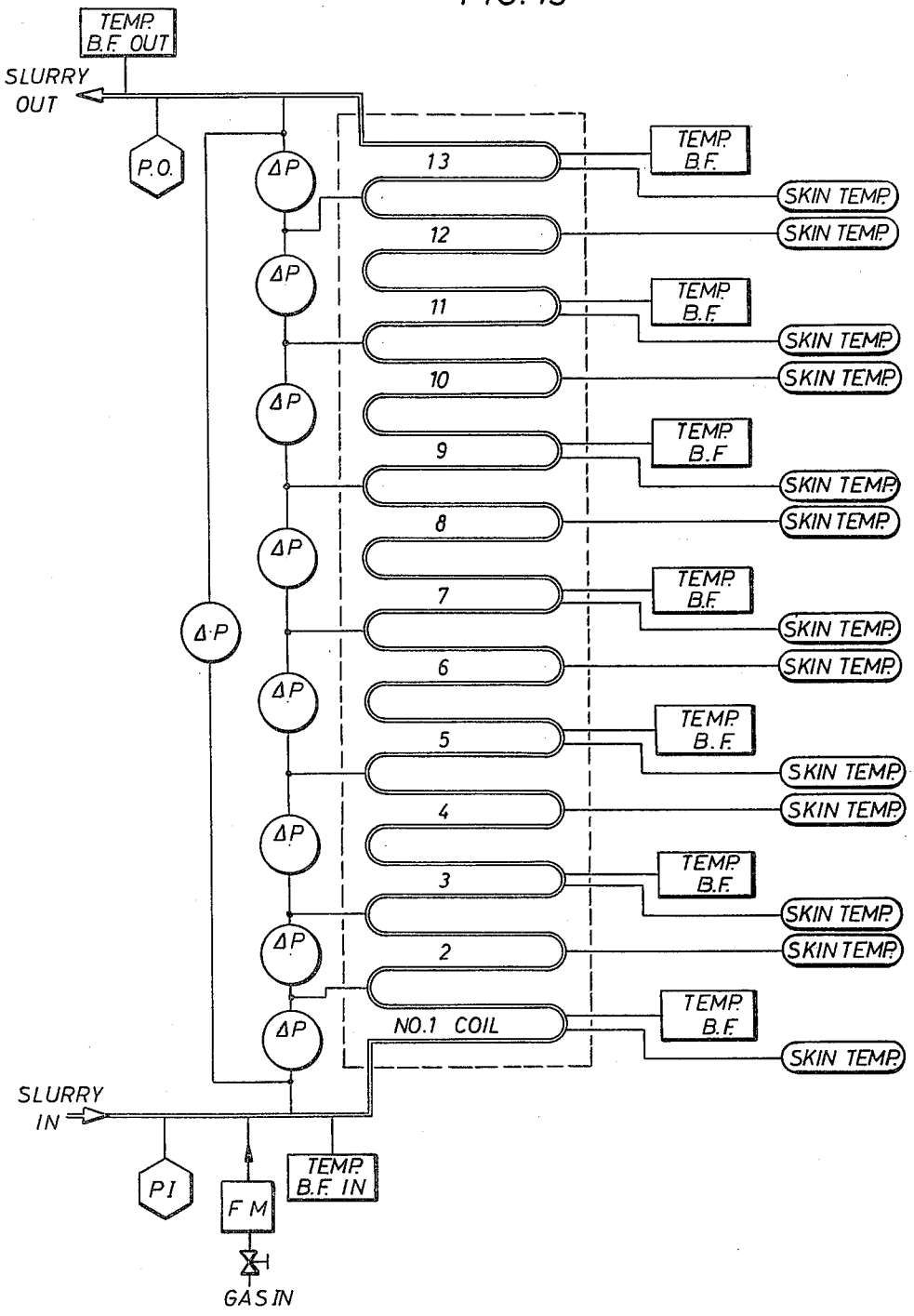
FIG. 15 is a schematic of a tubular preheater coil equipped with instrumentation to allow generation of skin and fluid temperature profiles and pressure drop profiles.

In studying the fluid dynamic behavior of coal-oil slurries, applicants used experimental coils having circular cross sections and arranged in race track configuration. One coil was a nominal two-inch coil (I.D. 1.689 in, wall thickness 0.344 inch) the other coil was a nominal one and one-half-inch coil (I.D. 1.338 in, wall thickness 0.281 inch). The coils were placed in a furnace which had both single fired and doubled fired regions. Each coil was equipped with instrumentation to provide accurate profiles of bulk fluid temperature, skin temperature, and pressure drop (both across defined increments and across the entire coil). A schematic of a preheater coil equipped with thermocouples, immersion couples, and differential pressure taps is shown in FIG. 15.

Viscosity of the slurry can be calculated with knowledge of incremental pressure drops over the length of the coil. A representative curve of slurry viscosity as a function of temperature is shown in FIG. 14.

The pressure drop correlation for two-phase flow developed by Duckler et al correlates pressure drop for a given segment to a two-phase friction factor. The two-phase friction factor in turn can be related to the Reynolds number for the mixture. The Reynolds number for the mixture is related to the viscosity of the mixture. Finally, once viscosity of the mixture is known the viscosity of the slurry can be calculated with knowledge of the viscosity of the gas and the volume fraction of slurry at the inlet. These relationships are defined as follows:

$$\frac{\Delta P}{L} = \frac{2G_M^2 FBf}{gD\rho_M} \quad (1)$$

where $$F = 1 - \frac{\ln Y_s}{1.281 + 0.478\ln Y_s + 0.444(\ln Y_s)^2 + 0.094(\ln Y_s)^3 + 0.0843(\ln Y_s)^4} \quad (2)$$

$$B = \left(\frac{\rho_s}{\rho_M}\right)\frac{(Y_L)^2}{(1-\epsilon_g)} + \left(\frac{\rho_G}{\rho_M}\right)\frac{(1-Y_s)^2}{\epsilon_g} \quad (3)$$

$f = 0.0014 + 0.125\, Re_M$ for $Re_s > 1{,}000$ or $f = 16/Re_M$ for $Re_s < 1{,}000$ $$Re_M = \frac{D_i G_M B}{\mu_M} \quad (5)$$

$$\rho_M = \rho_s Y_s + \rho_g (1 - Y_s) \quad (6)$$

$$\mu_M = \mu_S Y_S + \mu_g (1 - Y_s) \quad (7)$$

where

P=Pressure Drop for a segment
L=Length of a segment
G=Mass flowrate
FBf=two phase friction factor
Re=Reynolds Number
Y=Volume fraction at the inlet
$D_i$=Inside diameter of the coil
g=Gravity constant
$\rho$=Density
$\mu$=Viscosity
$\epsilon$=Holdup
subscript$_s$=Slurry
subscript$_M$=Slurry/gas mixture
subscript$_g$=Gas Use of the Duckler et al pressure drop correlation requires knowledge of gas holdup throughout the length of the coil. Applicants prefer to use the gas correlation of Hughmark which relates the volume fraction of gas to the gas/slurry velocity ratio through a flow parameter $K_b$. The Hughmark correlation can be expressed as:

$$\epsilon_g = K_b\left(\frac{U_g}{U_g + U_s}\right) \quad (8)$$

where $\epsilon_g$=Gas holdup
$U_g$=the superficial velocity of the gas
$U_s$=the superficial velocity of the slurry and
$K_b$=the flow parameter of Hughmark.

Figure 16:
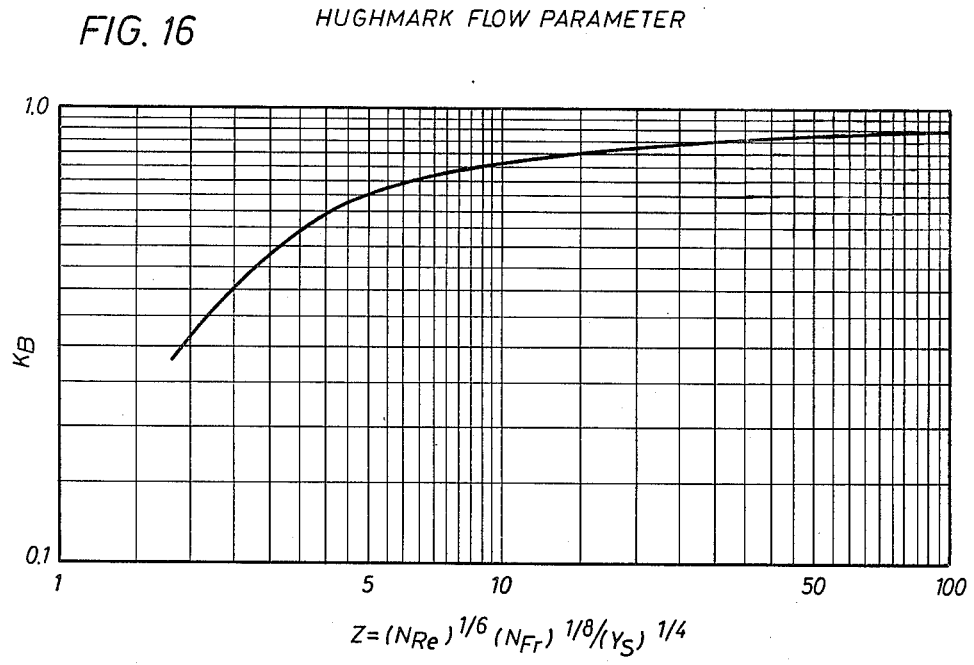
FIG. 16 is a graph of the Hughmark flow parameter, $K_B$, as a function of Mixture Reynolds number, Mixture Froude number, and volume fraction of slurry at the inlet to the heating zone.

The Hughmark flow parameter is a function of the mixture Reynolds number $Re_M$, the mixture Froude number $FR_M$, and the volume fraction of slurry at the inlet $Y_s$. Graphically the function is shown in FIG. 16.

The relationship is defined by the following equations:

$$K_b = 90.21064 - 68.29207 \log Z - 88.38673\, e^{-\log Z} + \quad (9)$$

-continued $$28.7349 (\log Z)^2 - 5.52341 (\log Z)^3 + 0.37977 (\log Z)^4 - 13.10734 (\log Z)^{\frac{1}{2}}$$

$$Z = (Re_M)^{1/6} (FR_M)^{\frac{1}{2}}/(Y_s)^{\frac{1}{4}} \quad (10)$$

$$Re_M = \frac{D_i G_M}{\epsilon_g \mu_g + (1 - \epsilon_g)\mu_S} \quad (11)$$

$$FR_M = \frac{(U_g + U_S)^2}{gD_i} \quad (12)$$

$Y_s$ = Volume fraction of slurry at the inlet to the heating zone where:

$Re_M$=Mixture Reynolds number
$FR_M$=Mixture Froude number
$Y_s$=Volume fraction of the slurry at the inlet
$D_i$=Inside diameter of the coil
$G_m$=Mass flow rate of the mixture
$U_s$=Superficial velocity of the slurry at the inlet
$U_g$=Superficial velocity of the gas at the inlet
g=The gravity constant
$\mu_s$=Apparent viscosity of the gas saturated slurry
$\mu_g$=Viscosity of the gas
$\rho_g$=Density of the gas
$\epsilon_g$=Gas holdup As the Mixture Reynolds number for a segment is dependent upon the gas holdup in that segment calculation of the function Z, and the flow parameter $K_B$, is an iterative process. The calculation can be performed by making an initial estimate of the Mixture Reynolds number as:

$$Re_M = \frac{D_i U_g \rho_g}{\mu_g} \quad (13)$$

Then the initial estimate of the function Z can be calculated; the initial estimate of the flow parameter $K_B$ can be calculated; and an initial estimate of gas holdup can be determined. The process can then be repeated using the initial estimate of gas holdup to calculate a second estimate of the Mixture Reynolds number, $Re_M$, according to equation 11 above. The second estimated gas holdup thus obtained can be used to further refine the estimate of Mixture Reynolds number, the function Z, the flow parameter $K_B$, and gas holdup. This iterative process can be repeated until the estimated gas holdup used to estimate Mixture Reynolds number converges with gas holdup calculated with equations 8 through 12 above.

When the apparent viscosity of the gas saturated slurry as a function of temperature curve is not available the Duckler et al pressure drop correlation (equations 1 to 7) can be combined with the Hughmark correlation (equations 8 to 12) to generate a slurry viscosity curve. The process is an iterative process which involves an initial estimate of apparent viscosity of the gas saturated slurry. For the first segment, 1, of the coil the first estimate of apparent viscosity of the gas saturated slurry can conveniently be the viscosity of the slurry at the inlet to the preheater. Using the initial estimate of Mixture Reynolds number shown in equation 13 an initial estimate of gas holdup can be obtained by calculating the function Z and the flow parameter, $K_B$. Then the estimate of gas holdup and Mixture Reynolds number can be refined by iterating the Hughmark correlation using the initial estimate of slurry viscosity until convergence.

The refined gas holdup can be used in the Duckler et al correlation to calculate a second estimate of slurry viscosity. This second estimate of slurry viscosity can be used to further refine the estimate of gas holdup by further iteration of the Hughmark correlation.

The process just described can be repeated until the calculated Mixture Reynolds number, apparent viscosity of the gas saturated slurry, and gas holdup converge with estimates used in the calculations.

Once the apparent viscosity of the gas saturated slurry for the first segment has been determined the viscosity for each succeeding segment can be calculated by repeating the iterative process for each segment. The initial estimate of slurry viscosity for each segment can conveniently be chosen as the slurry viscosity determined for the immediately preceding segment.

Repetition of this process for each segment of the coil will generate an accurate profile of apparent viscosity of the gas saturated slurry as a function of temperature. The slurry viscosities so generated can then be used to calculate a gas holdup profile for any given set of inlet superficial slurry velocities and superficial gas velocities. This calculation can be peformed by iterating the Hughmark correlation until convergence of the gas holdup used to calculate Mixture Reynolds number in equation 11 with the gas holdup calculated with flow parameter in equation 8.

Recently performed radiotracer tests have demonstrated the accuracy of the Hughmark correlation for coal-oil slurry streams. In the experiments conducted, separate measurements were made of the residence time distributions of the three phases. Tracing was accomplished by using radioactive gold-198 in a colloidal solution for solid phase measurements, bromine-82 in bromophenanthrene for liquid phase measurements, and argon-41 for gas phase measurements. These tests indicated that the solid and liquid phases passed through the coil at essentially the same speed. The gas holdup in the preheater coil could then be calculated from the actual gas and slurry transit times and the superficial slurry and gas velocities using the following equation:

$$\epsilon_g = \frac{1}{1 + \frac{t_s U_s}{t_g U_g}} \tag{14}$$

where $\epsilon_g$=gas holdup $t_s$=actual slurry transit time $t_g$=actual gas transit time $U_s$=superficial slurry velocity $U_g$=superficial gas velocity For one run the average values of $t_s$, $t_g$, $U_s$ and $U_g$ were substituted in the above equation (14) to calculate an average gas holdup of 0.55. The average gas holdup derived for the same runs with the Hughmark correlation was also 0.55.

Alternative correlations to determine apparent viscosity of the gas saturated slurry may be used. For example the Lockhart and Martinelli pressure drop correlation does not require knowledge of gas holdup. The test of whether a given correlation can successfully be used is whether the viscosity versus temperature curve generated with one set of conditions can be used consistently to accurately predict pressure drop profiles under different conditions.

Thermal conductivity of the slurry as a function of temperature can be determined from experimental runs where skin and fluid temperatures are carefully monitored. A representative curve of thermal conductivity of a gas saturated slurry as a function of temperature is shown in FIG. 5. The following equations can be used to calculate thermal conductivity:

$$\frac{\Delta H}{U_o A \pi D_o L} = (T_s - T_f)_{lm} \tag{15}$$

$$U_o A = \frac{\Delta H}{D_o L (T_s - T_f)_{lm}} \tag{16}$$

$$\frac{1}{U_o A} = \frac{D_o}{h_{i,TP} D_i} + \left(\frac{X_w}{K_w}\right)\left(\frac{D_o}{\overline{D}_L}\right) \tag{17}$$

where $X_w = \frac{D_o - D_i}{2}$ $K_w$ = thermal conductivity of metal $\overline{D}_L = \frac{D_o - D_i}{\ln D_o/D_i}$ $$\chi = \sqrt{\frac{\Delta P_{s,sp}}{\Delta P_{g,sp}}} \tag{18}$$

where $\Delta P_{s,sp}$ = Pressure Drop of Slurry flowing in pipe derived from superficial velocity of slurry $\Delta P_{g,sp}$ = Pressure Drop of Gas flowing in pipe derived from superficial velocity of gas $$\ln\alpha = -0.2844 + 0.4104\chi \tag{19}$$

$$\alpha = \frac{h_{i,TP}/h_s}{\phi_s^2} \tag{20}$$

$$\phi_s^2 = \frac{\Delta P_{TP}}{\Delta P_{s,TP}} = 1 + \frac{C}{\chi} + \frac{1}{\chi^2} \tag{21}$$

where $C$ = 12 for laminar − turbulent
or $C$ = 20 for turbulent − turbulent $$\frac{h_s D_i}{K_s} = 0.023\left(\frac{D_i G}{\mu_s}\right)^{0.8}\left(\frac{C_p \mu_s}{K_s}\right)^{0.4}\left(\frac{\mu_s}{\mu_w}\right)^{0.14} \text{for } Re_M \geqq 1{,}000 \tag{22}$$

or $$\frac{h_s D_i}{K_s} = 1.46\delta^{\frac{1}{3}}\left(\frac{G C_p}{K_s L}\right)^{\frac{1}{3}}\left(\frac{\mu_s}{\mu_w}\right)^{0.14} \text{for } Re_M < 1{,}000 \tag{23}$$

$\delta = \frac{3n+1}{4n}$ where $0 > n > 1$ for pseudo plastic fluids and $n = 1$ for Newtonian fluids where:

$\Delta H$=enthalpy $U_o A$=overall heat transfer $D_o$=outside diameter $D_i$=inside diameter $T_s$=skin temperature $T_f$=inside fluid temperature $h_{i,TP}$=inside film heat transfer coefficient gas/slurry mixture $h_s$=heat transfer coefficient slurry $K_s$=thermal conductivity slurry G=mass flowrate slurry $C_p$=specific heat slurry L=length of segment
$\Delta P_{TP}$=Overall pressure drop across segment
$\Delta P_{s,TP}$=Slurry pressure drop across segment
$\chi$=Lockhart Martinelli parameter
$\mu_s$=viscosity of slurry
$\mu_w$=viscosity of slurry at the wall
$\delta=(3n+1)/4n$ where n=Newtonian/non-newtonian behavior index,
$0>n>1$ for pseudo-plastic fluids
n=1 for Newtonian fluids
subscript$_{lm}$=log mean The first step in calculation of thermal conductivity, is calculation in equation 16 of overall heat transfer coefficient $U_o^A$, with knowledge of the difference between the skin and fluid temperature ($T_s-T_f$) and the enthalpy, $\Delta H$. The overall heat transfer coefficient can then be related through equation 17 to an inside wall film resistance, $h_{i,TP}$, with knowledge of the outside and inside wall diameters and the thermal conductivity of the metal. Once the heat transfer coefficient of the inside film is known the heat transfer coefficient of the gas saturated slurry, $h_s$, can be calculated with the correlation of Johnson and Abou-Sabe equations 19–21. Use of the Johnson and Abou-Sabe correlation requires calculation of the Lockhart-Martinelli parameter, $\chi$ with equation 18.

The heat transfer coefficient of the slurry, $h_s$, can be used to determine thermal conductivity with knowledge of the slurry specific heat and the viscosity of the slurry at any given temperature. Where the flow is turbulent applicants prefer to relate the heat transfer coefficient of the slurry to thermal conductivity with the Dittus-Boelter equation with the Sieder-Tate correction, equation 22. In that equation the only unknowns are thermal conductivity and apparent viscosity of the gas saturated slurry both in the fluid bulk and at the wall. The apparent viscosity figures can be taken from the apparent viscosity curve such as that shown in FIG. 14 prepared from pressure drop data. Thus, $\mu_s$ is the apparent viscosity at the given temperature $T_f$ while $\mu_w$ is the apparent viscosity at the wall for a temperature $T_s$.

Where the slurry is in laminar flow, with a Reynolds number less than 1,000, applicants prefer to use equation 13 which is a modification of the Leveque correlation with the Sieder-Tate viscosity correction. In this equation $\delta$ is a correction for non-Newtonian behavior. Since applicants have found that the coal-oil slurries behave essentially as Newtonian fluids at the temperatures and pressures encountered in the preheater and at shear rates greater than or equal to 150 sec.$^{-1}$, $\delta$ can be treated as one. To the minimal extent that the fluid may be pseudo plastic under these conditions the assumption that n=1 (and therefore $\delta=1$) is still permissible for design purposes. Since the behavior index for pseudo plastic fluids, n, falls between 0 and 1 the assumption of n=1 is a conservative assumption which will result in a thermal conductivity which if anything is slightly greater than the thermal conductivity of the slurry.

Once the properties of the coal-oil slurry as it goes through the preheater have been determined it is possible to evaluate various design alternatives including: coil configuration, number of passes, tube size, and coil length.

Applicants prefer a race track coil configuration with tubes having a uniform circular cross section because they have extensive experience with this configuration in experimental coils. A variety of other configurations should work in the present invention.

The specification of the number of passes, the coil length, and the tube size are all interrelated and dependent upon pressure drop and heat transfer. The specification process begins with specification of tube size and heat flux. Applicants prefer to maximize tube size in order to keep tube length to minimum. Thus, applicants prefer to specify six-inch tubes. Larger tube sizes are rarely used because of excessive thermal stresses on the tube wall associated with increasing thermal gradients and because of fabrication problems. Once the tube size has been selected, the tube length required to bring the slurry to reaction temperature can be determined for a variety of heat fluxes. For any given length of coil as the number of passes is increased the mass velocity of the slurry flowing through the passes is decreased. The effect of decreasing mass velocity is to decrease heat transfer. Thus increasing the number of passes results in use of a lower heat flux. Accordingly, applicants prefer to minimize the number of passes and maximize heat flux in the preheater coil. Where more throughput is required than is possible with a six-inch coil, multiple preheater units can be used.

Once various design alternatives have been established their feasibility can be evaluated for pumping and heat transfer efficiency at various heat fluxes. Pressure drops across the coil can be predicted for any given design with use of the Duckler et al correlation for pressure drop. Similarly, maximum skin temperatures for any given design can be calculated with equations 15 through 23 set forth above. In this process, predicted skin and fluid temperature profiles are calculated. For any given segment, a first assumption of skin and bulk temperatures is made. Then the apparent viscosities for the slurry at the tube wall and in the bulk are estimated for use in either the Dittus-Boelter equation, equation 22 or the Leveque equation, equation 23. Working with those equations it is possible to predict first, the heat transfer coefficient for the slurry, then with equations 18 to 21 the inside film heat transfer coefficient and the overall heat transfer coefficient with equation 17. Finally, predicted skin and fluid temperatures can be calculated with equation 15. If these temperatures differ from those of the first approximation the process can be repeated until the estimated skin and fluid temperatures converge with the calculated skin and fluid temperatures.

Prediction of pressure drops across the coil using the Duckler et al correlation involves calculation of gas holdup. When evaluating various design configurations, alternatives for introduction of varying quantities of hydrogen containing gas can also be evaluated. For example, each proposed design configuration can be evaluated with 100%, 75%, and 50% of the total preheater hydrogen available from the gasifier and shift reactor being added at the preheater inlet. Where less than 100% of the preheater hydrogen is added at the preheater inlet the remaining fraction of preheater hydrogen can be heated independently and introduced downstream of the preheater at the inlet to the dissolver.

Applicants prefer to program a computer to perform the calculations involved in evaluating various design alternatives. The results of three such a computer evaluation appear in Tables II, III and IV.

TABLE II

Summarized Analysis of Design For Six Inch (Fifteen Centimeter) Coil With Eight Passes Slurry Rate = 208,147 lb/hr (94,612 Kg/hr)
Total solids = 45% by weight Coal Concentration = 30% by weight

| Heater Outlet Temp, °F. (°C.) | Heat Flux Btu/Hr-Ft$^2$ (Kcal/Hr-M$^2$) | Length per pass Ft (M) | Pressure Drop lb/in$^2$ (Newt/cm$^2$) | Max skin Temp °F. (°C.) | Max Film Temp °F. (°C.) | Gas Holdup Minimum |
|---|---|---|---|---|---|---|
| Case A: 100% Preheater $H_2$ Introduced at Preheater Inlet Gas Rate = 4,888 lb/hr (2,222 Kg/hr) | | | | | | |
| 767 (408) | 12,000 (32,400) | 2400 (732) | 434 (299) | 975 (524) | 902 (483) | 0.55 |
| 753 (400) | 10,000 (27,000) | 2800 (853) | 508 (351) | 936 (502) | 882 (472) | 0.55 |
| 732 (389) | 9,500 (25,650) | 2800 (853) | 530 (366) | 931 (499) | 874 (467) | 0.55 |
| Case B: 75% Preheater $H_2$ Introduced at Preheater Inlet Gas Rate = 3,666 lb/hr (1,666 Kg/hr) | | | | | | |
| 762 (406) | 12.000 (32,400) | 2300 (701) | 386 (266) | 988 (531) | 915 (491) | 0.48 |
| 751 (399) | 10,000 (27,000) | 2700 (823) | 462 (319) | 955 (513) | 895 (479) | 0.48 |
| 745 (396) | 9,500 (25,650) | 2800 (853) | 485 (335) | 945 (507) | 888 (475) | 0.48 |
| Case C: 60% Preheater $H_2$ Introduced at Preheater Inlet Gas Rate = 2.933 lb/hr (1,333 Kg/hr) | | | | | | |
| 771 (411) | 12,000 (32,400) | 2300 (701) | 361 (249) | 1000 (538) | 934 (501) | 0.44 |
| 760 (404) | 10,000 (27,000) | 2700 (823) | 432 (298) | 968 (520) | 908 (487) | 0.44 |
| 753 (400) | 9,500 (25,650) | 2800 (853) | 454 (313) | 945 (507) | 888 (475) | 0.44 |
| Case D: 50% Preheater $H_2$ Introduced at Preheater Inlet Gas Rate = 2,444 lb/hr (1,111 Kg/hr) | | | | | | |
| 772 (411) | 12,000 (32,400) | 2300 (701) | 341 (235) | 1000 (538) | 943 (506) | 0.39 |
| 766 (408) | 10,000 (27,000) | 2700 (823) | 409 (282) | 966 (519) | 905 (485) | 0.39 |
| 758 (403) | 9,500 (25,650) | 2800 (853) | 429 (296) | 964 (518) | 907 (486) | 0.39 |

TABLE III

Summarized Analysis of Design For Six Inch (Fifteen Centimeter) Coil With Twelve Passes Slurry Rate = 156,110 lb/hr (70,959 Kg/hr)
Total solids = 45% by weight Coal Concentration = 30% by weight

| Heater Outlet Temp, °F. (°C.) | Heat Flux Btu/Hr-Ft$^2$ (Kcal/Hr-M$^2$) | Length per pass Ft (M) | Pressure Drop lb/in$^2$ (Newt/cm$^2$) | Max skin Temp °F. (°C.) | Max Film Temp °F. (°C.) | Gas Holdup Minimum |
|---|---|---|---|---|---|---|
| Case A: 100% Preheater $H_2$ Introduced at Preheater Inlet Gas Rate = 3,666 lb/hr (1,666 Kg/hr) | | | | | | |
| 767 (408) | 12,000 (32,400) | 1800 (549) | 239 (165) | 1000 (538) | 936 (502) | 0.54 |
| 777 (414) | 10,000 (27,000) | 2200 (671) | 292 (201) | 968 (520) | 908 (487) | 0.54 |
| 773 (412) | 9,500 (25,650) | 2300 (701) | 302 (208) | 952 (511) | 894 (479) | 0.54 |
| Case B: 75% Preheater $H_2$ Introduced at Preheater Inlet Gas Rate = 2,750 lb/hr (1,250 Kg/hr) | | | | | | |
| 784 (417) | 12,000 (32,400) | 1800 (549) | 218 (150) | 1000 (538) | 950 (510) | 0.46 |
| 769 (409) | 10,000 (27,000) | 2100 (640) | 261 (180) | 986 (530) | 926 (497) | 0.46 |
| 766 (408) | 9,500 (25,650) | 2200 (671) | 275 (190) | 976 (524) | 919 (493) | 0.46 |
| Case C: 60% Preheater $H_2$ Introduced at Preheater Inlet Gas Rate = 2,200 lb/hr (1,000 Kg/hr) | | | | | | |
| 763 (406) | 12,000 (32,000) | 1700 (518) | 203 (140) | 1000 (538) | 959 (915) | 0.41 |
| 779 (415) | 10,000 (27,000) | 2100 (640) | 244 (168) | 999 (537) | 939 (503) | 0.41 |
| 776 (413) | 9,500 (25,650) | 2200 (671) | 257 (177) | 989 (532) | 932 (500) | 0.41 |
| Case D: 50% Preheater $H_2$ Introduced at Preheater Inlet Gas Rate = 1,833 lb/hr (833 Kg/hr) | | | | | | |
| 770 (410) | 12,000 (32,000) | 1700 (518) | 192 (133) | 1000 (538) | 974 (467) | 0.37 |
| 759 (402) | 10,000 (27,000) | 2000 (610) | 229 (158) | 1000 (538) | 947 (508) | 0.37 |
| 758 (403) | 9,500 (25,650) | 2100 (640) | 241 (166) | 999 (537) | 942 (506) | 0.37 |

TABLE IV

Summarized Analysis of Design For Eight Inch (Twenty Centimeter) Coil With Eight Passes Slurry Rate = 208,147 lb/hr (94,612 Kg/hr)
Total solids = 45% by weight Coal Concentration = 30% by weight

| Heater Outlet Temp, °F. (°C.) | Heat Flux Btu/Hr-Ft$^2$ (Kcal/Hr-M$^2$) | Length per pass Ft (M) | Pressure Drop lb/in$^2$ (Newt/cm$^2$) | Max skin Temp °F. (°C.) | Max Film Temp °F. (°C.) | Gas Holdup Minimum |
|---|---|---|---|---|---|---|
| Case A: 100% Preheater $H_2$ Introduced at Preheater Inlet Gas Rate = 4,888 lb/hr (2,222 Kg/hr) | | | | | | |
| 783 (417) | 12,000 (32,400) | 1900 (579) | 108 (75) | 1000 (538) | 956 (513) | 0.52 |

TABLE IV-continued

Summarized Analysis of Design For Eight Inch (Twenty Centimeter) Coil With Eight Passes Slurry Rate = 208,147 lb/hr (94,612 Kg/hr)
Total solids = 45% by weight Coal Concentration = 30% by weight

| Heater Outlet Temp, °F. (°C.) | Heat Flux Btu/Hr-Ft$^2$ (Kcal/Hr-M$^2$) | Length per pass Ft (M) | Pressure Drop lb/in$^2$ (Newt/cm$^2$) | Max skin Temp °F. (°C.) | Max Film Temp °F. (°C.) | Gas Holdup Minimum |
|---|---|---|---|---|---|---|
| 765 (407) | 10,000 (27,000) | 2200 (671) | 127 (88) | 999 (537) | 926 (497) | 0.52 |
| 761 (405) | 9,500 (25,650) | 2300 (701) | 133 (92) | 992 (533) | 923 (495) | 0.52 |
| | Case B: | 75% Preheater $H_2$ Introduced at Preheater Inlet Gas Rate = 3,666 lb/hr (1,666 Kg/hr) | | | | |
| 771 (411) | 12,000 (32,400) | 1800 (549) | 96 (66) | 1000 (538) | 1000 (538) | 0.44 |
| 757 (403) | 10,000 (27,000) | 2100 (640) | 115 (79) | 1000 (538) | 950 (510) | 0.44 |
| 755 (402) | 9,500 (24,650) | 2200 (671) | 121 (83) | 1000 (538) | 941 (505) | 0.44 |
| | Case C: | 60% Preheater $H_2$ Introduced at Preheater Inlet Gas Rate = 2,933 lb/hr (1,333 Kg/hr) | | | | |
| 781 (416) | 12,000 (32,400) | 1800 (549) | 90 (62) | 1000 (538) | 992 (533) | 0.39 |
| 766 (408) | 10,000 (27,000) | 2100 (640) | 108 (75) | 1000 (538) | 956 (513) | 0.39 |
| 764 (407) | 9,500 (25,650) | 2200 (671) | 114 (79) | 1000 (538) | 950 (510) | 0.39 |
| | Case D: | 50% Preheater $H_2$ Introduced at Preheater Inlet Gas Rate = 2,444 lb/hr (1,111 Kg/hr) | | | | |
| 787 (419) | 12,000 (32,400) | 1800 (549) | 85 (59) | 1000 (533) | 1000 (538) | 0.35 |
| 773 (412) | 10,000 (27,000) | 2100 (640) | 102 (70) | 1000 (538) | 962 (517) | 0.35 |
| 770 (410) | 9,500 (25,650) | 2200 (671) | 107 (74) | 1000 (538) | 951 (511) | 0.35 |

As can be seen from the figures in Tables II, III and IV, use of an eight-inch nominal diameter coil would result in considerably less pressure drop than a six-inch nominal diameter coil [I.D.=5.14 in (13.1 cm) O.D.=6.62 in (16.8 cm)]. However, the maximum film temperature is 923° F. (495° C.) with even the lowest heat flux considered, 9,500 btu/hr-ft$^2$ and 100% of the preheater hydrogen put in at the preheater inlet. This maximum film temperature is too close to the design maximum of 925° F. (496° C.) for comfort. Similarly, the six-inch coil with 12 passes presents better pressure drop figures than the six-inch coil with eight passes. However, here again the inside maximum film temperature for even the lowest heat flux level at 9500 btu/hr-ft$^2$ (25,600 kcal/hr-M$^2$) is greater than the specified maximum of 925° F. (496° C.) Accordingly, the eight-inch coil with eight passes and the six-inch coil with twelve passes are not preferred designs. Applicants prefer that skin temperature be maintained below 950° F. (510° C.) so that inside film temperatures remain below the specified 925° F. (496° C.). The specification of a maximum skin temperature at 950° F. (510° C.) is a conservative specification based on the conservative conclusion that inside film temperatures greater than 925° F. (496° C.) may present problems with coking. Since the inside film temperature is usually somewhat less than the tube wall temperature, operation with a tube wall temperature as high as 975° F. (524° C.) may be satisfatory. Applicants do not however recommend such a high tube wall temperature.

Figure 17:
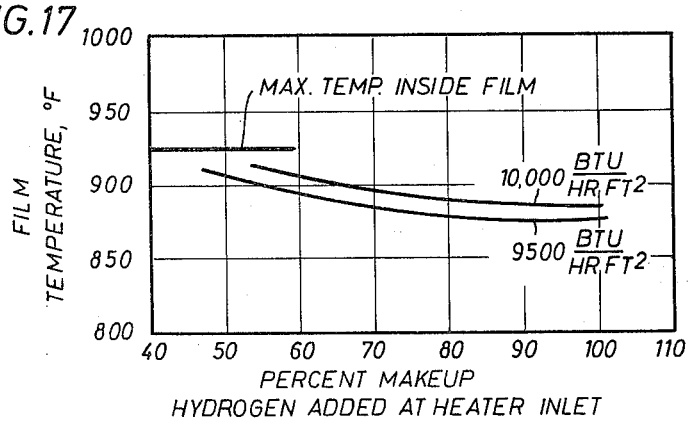
FIG. 17 shows simulated maximum inside film temperatures at two average heat fluxes as a function of percent total preheater hydrogen introduced at the inlet to the heating zone.

The design preferred in the study set forth is the six-inch coil with eight passes. As can be seen from FIG. 17 the design maximum inside film temperature of 925° F. (496° C.) is not exceeded with either of the 10,000 btu/hr-ft$^2$ (27,000 kcal/hr-M$^2$) or the 9,500 btu/hr-ft$^2$ (25,600 kcal/hr-M$^2$) average heat flux.

Figure 18:
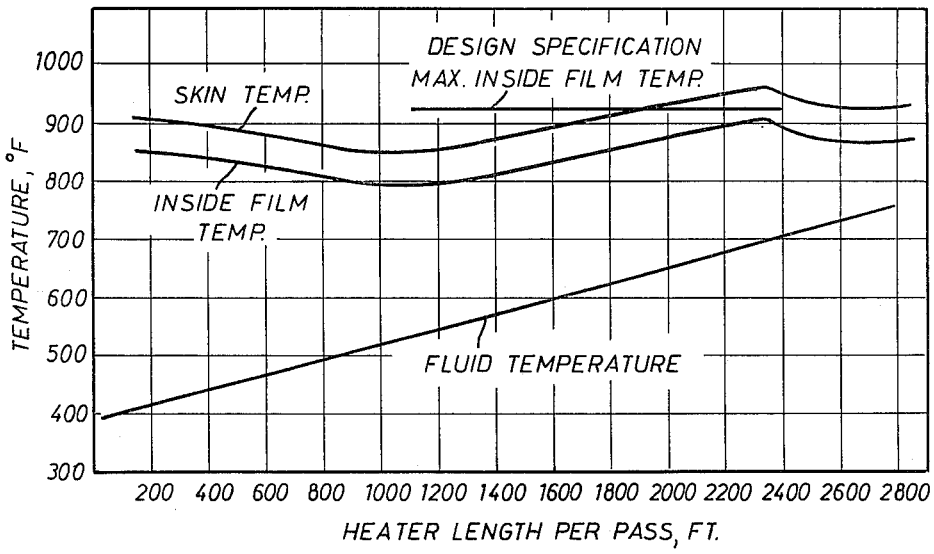
FIG. 18 is a graph of simulated bulk fluid, inside film, and tube wall (skin) temperatures as a function of heater length.
Figure 19:
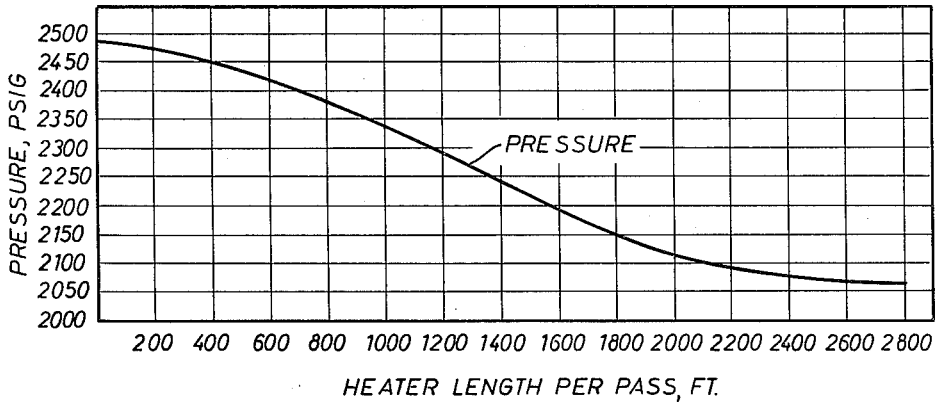
FIG. 19 is a graph of simulated pressure as a function of heater length.

The predicted temperature and pressure profiles through the heater for a six-inch coil with eight passes wherein 50% of the total preheater hydrogen is introduced at the preheater inlet and an average heat flux of 10,000 btu/hr-ft$^2$ (27,000 kcal/hr-M$^2$) is maintained are shown in FIGS. 18 and 19. As can be seen from FIG. 18, the maximum inside film temperature is well below the specified film temperature.

Figure 20:
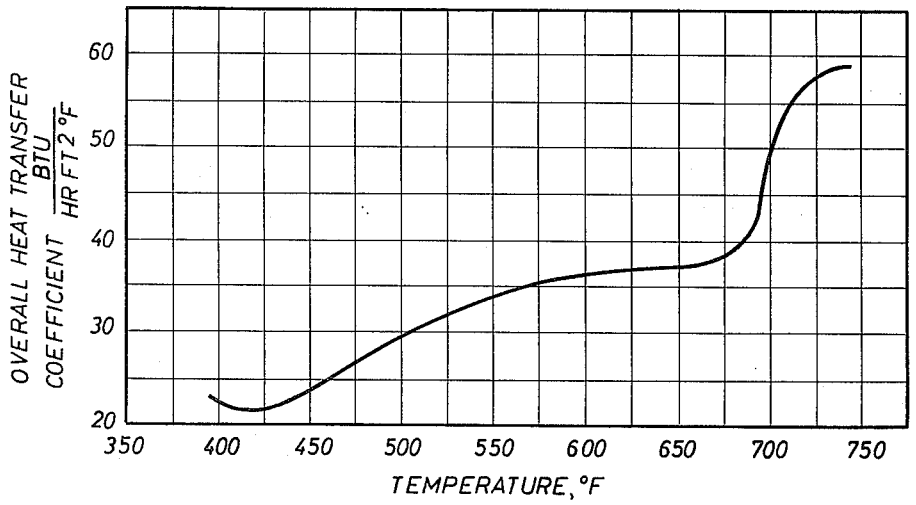
FIG. 20 is a graph of simulated overall heat transfer coefficient as a function of temperature for a representative coal-oil slurry and hydrogen containing gas stream.

FIG. 18 also demonstrates that the maxima in the temperature curves occur towards the heater outlet but not at the outlet itself. The estimated fluid temperature profile is a function of assumed heat effects in the slurry preheater, i.e. their magnitude and their location, and the design average heat flux. Depending on the magnitude of these heat effects and the extent to which they affect the enthalpy as a function of temperature curve, heat flux may have to be adjusted throughout the preheater in order to achieve a monotonic temperature profile for the fluid through the heater. The need for higher heat fluxes for a section of the heater does not, however, necessarily imply higher skin and inside film temperatures for that section of the heater. For example, an increase in heat transfer coefficient in response to the change in fluid properties and vapor liquid distribution in the sections of higher heat flux would avoid increased temperatures at the skin and wall. A typical profile of overall heat transfer coefficient through the preheater is shown in FIG. 20. Multiple heat flux zones can be designed into the system in a variety of ways. One convenient way involves separating the coil into separate zones which are enclosed in different fire boxes.

Of the design alternatives presented above applicants prefer an eight pass heater with a six-inch nominal diameter (6.62 in (13.1 CM) O.D. and 5.14 in (16.8 CM) I.D.) tube size and with 2,800 feet (853 M) per pass. The preferred minimum required hydrogen at the heater inlet is 50% of the total preheater hydrogen. In the preferred design each pass is a rounded rectangle configuration with nearly horizontally disposed radiant tubes. The six-inch radiant tube is type 321 stainless steel and has a circular cross section. Each pass will have its own high pressure feed slurry pump. No flow distribution among the passes is needed in this configuration. The preferred design average heat flux is 10,000 btu/hr-ft$^2$ (27,000 kcal/hr-M$^2$). The fire box should be designed to insure that the longitudinal or circumferential variations of heat flux do not exceed twenty percent.

In this design evaluation a heat duty of $382\times10^6$ btu/hr ($96\times10^6$ kcal/hr) for the heater was used. This estimate of heat duty was derived using a heater outlet temperature of 746° F. (397° C.) and an endothermic heat of reaction of 70 btu/lb (40 kcal/kg) of coal. There may be occasions where it is desired to heat the coal-oil slurry to a temperature somewhat higher than the 746° F. (397° C.). Similarly, the endothermic heat of reaction for dissolution of coal is not accurately known. Accordingly, applicants prefer to increase by $20\times10^6$ btu/hr ($5\times10^6$ kcal/hr) the heat duty required of the furnace. Thus if necessary the preheater can be operated at an increased heat flux level of about 10,500 btu/hr-ft$^2$ (28,350 kcal/hr-ft$^2$) compared to the design average heat flux of 10,000 btu/hr-ft$^2$ (27,000 kcal/hr-M$^2$). Operation at this level should not exceed temperature limitations. In fact the preheater can be operated even at a somewhat higher heat flux of 12,000 btu/hr-ft$^2$ (32,400 kcal/hr-M$^2$) with 100% of total preheater hydrogen.

An alternative design can be used to take advantage of the high thermal conductivity (and therefore high heat transfer coefficients) in the temperature range from 450° F. (232° C.) to 650° F. (343° C.). In this design the coil is divided into three segments in three fire boxes. The first and last segments should be designed to maintain an average heat flux ranging from 8,000 to 12,000 btu/hr-ft$^2$ (21,600–32,400 kcal/m$^2$-hr). The second segment should be designed to maintain an average heat flux ranging from 12,000 to 18,000 btu/hr-ft (21,600–48,816 kcal/m$^2$-hr. Then the slurry flowing through the first segment can be heated to about 450° F. (232° C.). In the middle segment the slurry can be heated to about 650° F. (343° C.). Finally the slurry in the last segment can be heated to the inlet temperature for the dissolver of about 750° F. (399° C.).

Still further heat transfer efficiency could be achieved by adding yet another heating zone with a high heat flux at the end of the coil. As shown in the example of FIG. 20, the overall heat transfer coefficient dramatically increases at a bulk temperature of about 700° F. (371° C.). A heating zone with increased heat flux could be used to rapidly heat the fluid beyond 700 (371° C.). Applicants would not, however, prefer to use this fourth heating zone because the design outlet temperture is 746° F. (397° C.). Construction of an extra heating zone for only about 50° F. (28° C.) would not be economically efficient.

Operation of the preheater described above in accordance with the present invention requires introduction of sufficient gas at the preheater inlet to achieve homogeneous flow in those segments of the preheater where the bulk slurry is heated from 500° F. (260° C.) to 600° F. (332° C.) at a minimum. Preferably homogeneous flow should be maintained while the bulk temperature is raised from about 450° F. (232° C.) to about 650° F. (343° C.). Most preferably homogenous flow should be maintained throughout the entire heating zone. The term homogeneous flow is intended to include all flow regimes where the gas phase and slurry phases are intimately admixed. Such flow regimes include dispersed, dispersed bubble, and elongated bubble.

As can be seen in Table II introduction of 50% of the preheater hydrogen will result in a minimum gas holdup throughout the coil of 0.39. As can also be seen in Table II the six-inch coil with eight passes can be operated with an average heat flux of 9,500 btu/hr-ft$^2$ (25,650 kcal/hr-M$^2$) with 100% of the preheater hydrogen introduced at the preheater inlet. In that mode of operation the pressure drop will be greater than with only 50% of the hydrogen introduced. However, operation will be stable.

Once the preheater has been designed the minimum amount of hydrogen required for stable operation can be found by starting with a relatively high gas flow rate and then decreasing the gas flow rate until unstable conditions are observed. As explained above these unstable flow conditions are characterized by a sudden increase and then a decrease in overall pressure drop, an increase in skin temperatures, erratic oscillations in both skin and fluid temperatures, and sometimes an observation of decreasing fluid temperature at the end of the coil. Of course, this technique for finding a minimum critical gas rate cannot be substituted for properly designing a preheater that can be operated at optimum conditions for a particular system.

Figure 21:
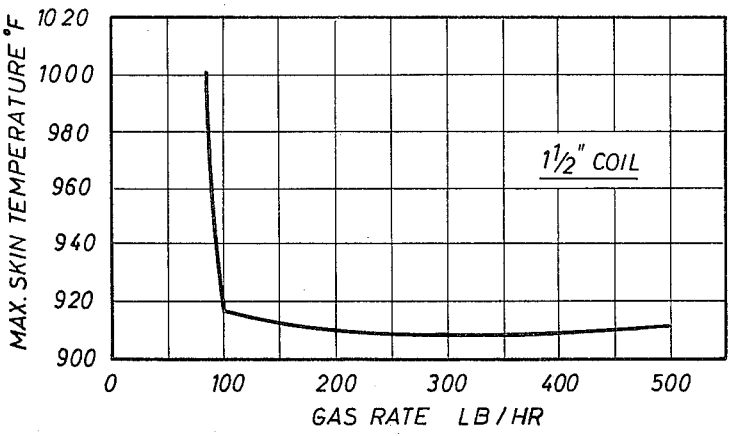
FIG. 21 is a graph of maximum skin temperatures as a function of hydrogen containing gas flow rate at the inlet to the heating zone for a representative coal-oil slurry and hydrogen containing gas stream.

The effect of gas to slurry volume ratios on heat transfer in coal-oil slurries can be seen in FIG. 21. The maximum skin temperature which indicates heat transfer efficiency dramatically decreases (indicating improved heat transfer efficiency) as gas rate increases to the minimum critical flowrate. Further improvements in heat transfer with increased gas flowrate are less significant.

Figure 22:
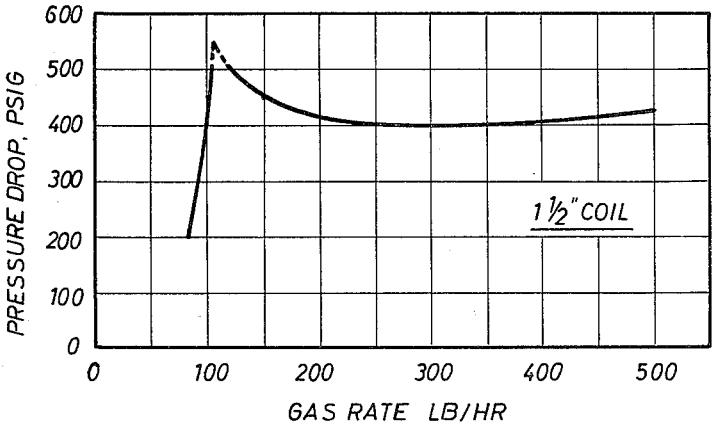
FIG. 22 is a graph of overall pressure drop as a function of hydrogen containing gas flow rate at the inlet to the heating zone for a representative coal-oil slurry and hydrogen containing gas stream.

The effect of gas to slurry volume ratio on pressure drop is shown in FIG. 22. The fluctuation in pressure drop as gas rate is decreased is very dramatic in this case where coal concentration is 30% by weight. Applicants were unable to measure pressure drops greater than 500 psi. The portions of the pressure drop curve above 500 psi are extrapolated. The optimum gas flow rate for the system shown in FIGS. 21 and 22 is about 240 lb/hr. At that flow rate the overall pressure drop is the lowest possible without shifting into an unstable flow regime. In this instance the maximum skin temperature is close to its lowest. Applicants prefer to minimize pressure drop in the range of stable operation rather than maximize heat transfer because of costs. The increased cost of greater pumping capacity required to handle increased pressure drops when heat transfer is maximized outweigh the savings obtained with improved heat transfer.

Figure 23B:
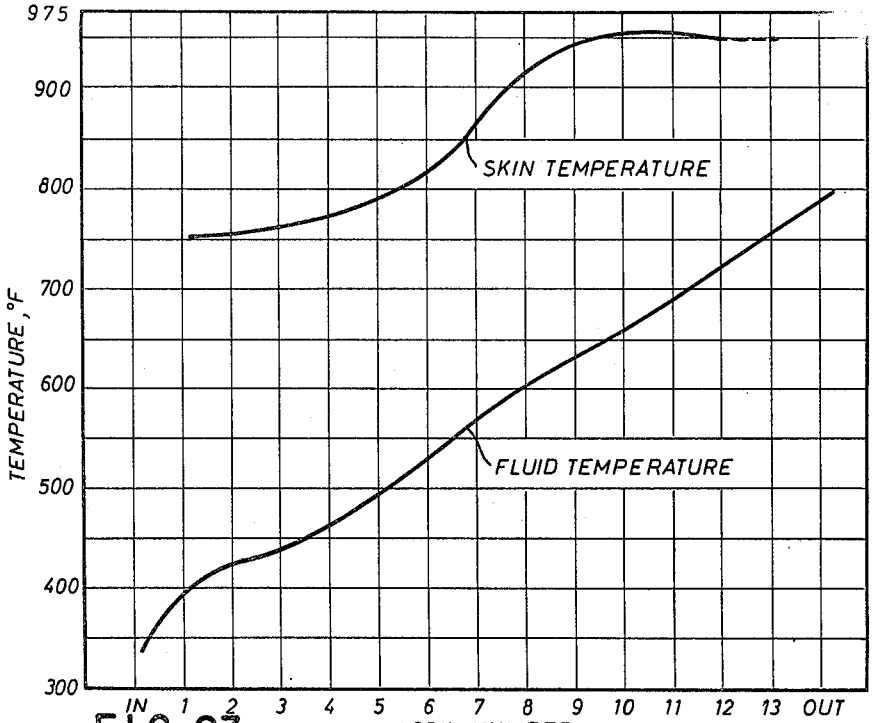
FIG. 23 is a graph comparing skin and bulk fluid temperature profiles for stable (FIG. 23*a*) and unstable (FIG. 23*b*) heating of a coal-oil slurry and hydrogen containing gas stream.
Figure 23A:
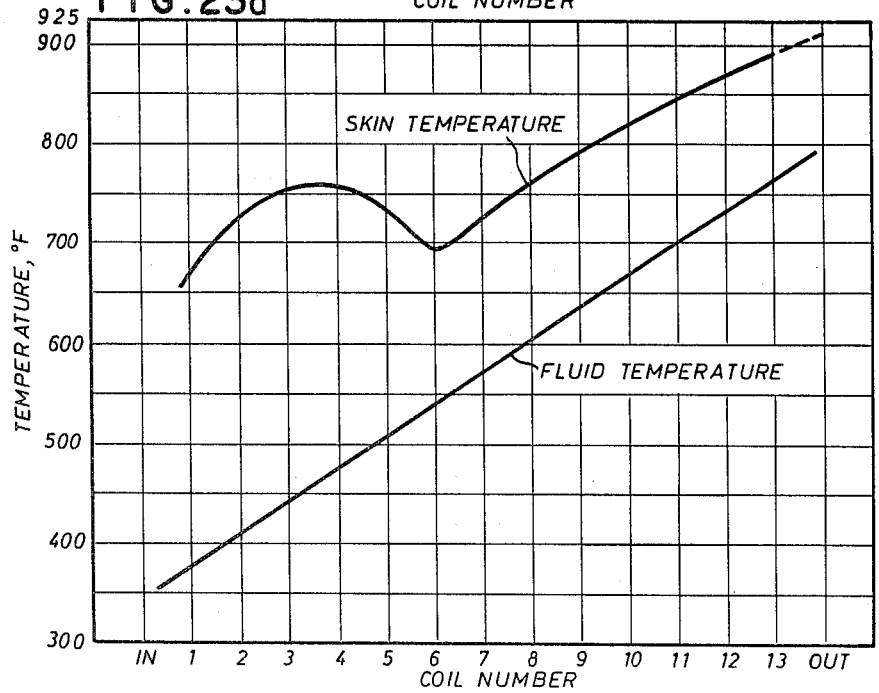
Figure 24:
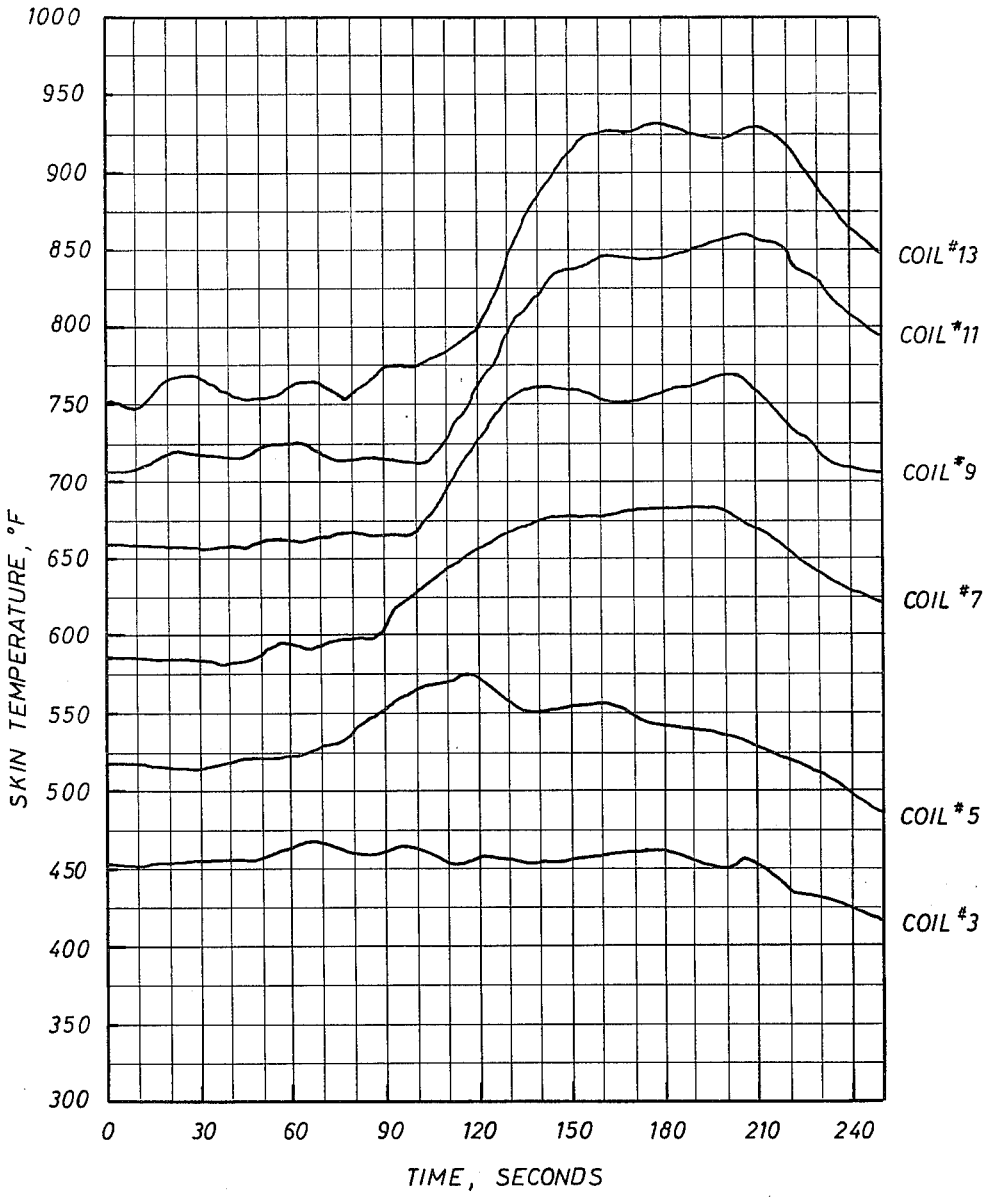
FIG. 24 is a plot of temperature readings at points along the length of a tubular preheater as a function of time demonstrating unstable flow conditions.

The other symptoms of unstable flow are shown in FIGS. 23 and 24. FIG. 23 compares the skin/fluid temperature profiles for stable and unstable flow. The difference between the skin and fluid temperatures is higher in unstable flow. FIG. 24 shows temperature excursions at several points along the coil. The temperature at the measurement point on the last coil actually climbed about 180° F. (100° C.) in about 1.5 minutes. The final symptom of flow instability occurs when the last fluid temperature measurement inside the coil is higher than the fluid temperature at the outlet of the coil. Applicants believe this last symptom occurs when the stream has split into slug flow and inaccurate or nonrepresentative temperature measurement results.

Figure 25:
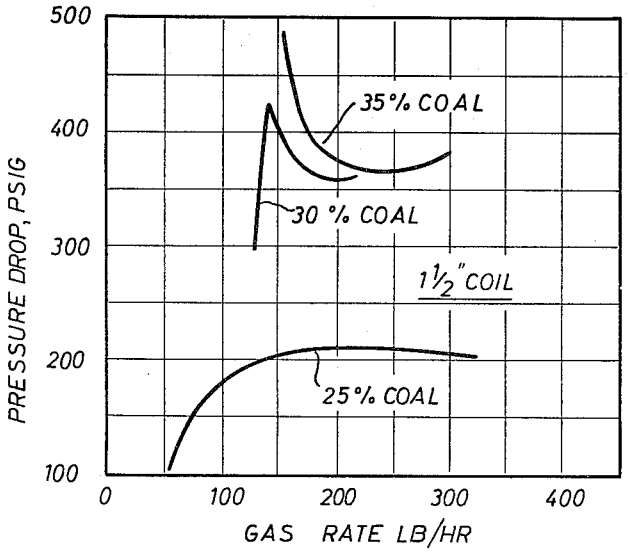
FIG. 25 is a graph comparing the effect of coal concentration on overall pressure drop as a function of hydrogen containing gas rate at the inlet to a tubular heating zone.

Many factors influence the onset and severity of unstable flow conditions. One important factor is the concentration of coal in the slurry. FIG. 25 shows the effect of coal concentration on pressure drop throughout the coil. In this example the total percent solids in the recycle slurry is held constant so that addition of extra coal increases the total solids concentration for the coal-oil slurry flowing through the coil. At 25% by weight coal concentration the effect of gas flow rate on the pressure drop is hardly discernable. In many runs where the coal concentration was less than 25% the effect on pressure drop of reducing the gas rate below the minimum critical gas rate could not be discerned. The transition to unstable flow is quite clear where the coal-oil slurry contains 30% coal. Finally, on some occasions the pressure drops became so high with a coal concentration of 35% that applicants were unable to accurately determine the flow rate at which the maximum pressure drop occurred. However, by operating with sufficient hydrogen coal-oil slurries containing 35% by weight coal can be heated with efficient heat transfer and acceptable pressure drops.

Figure 26:
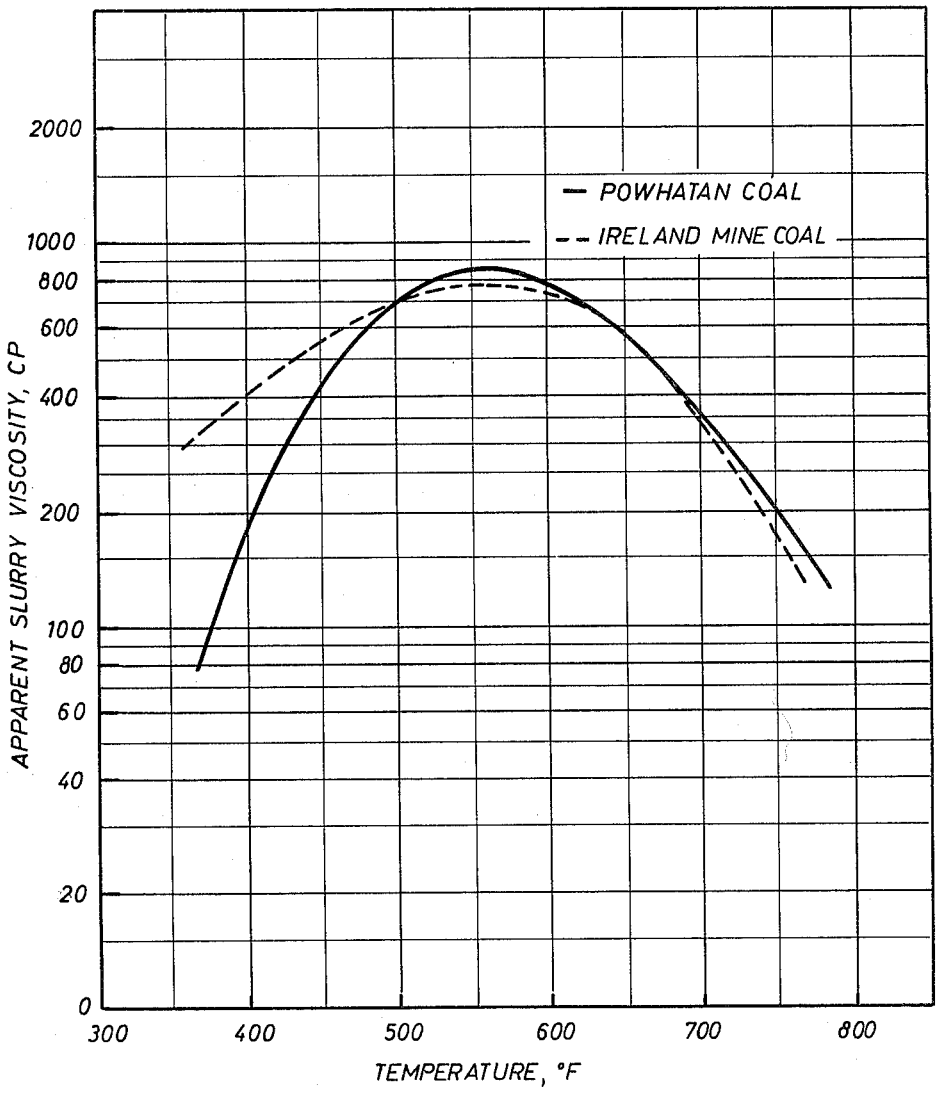
FIG. 26 is a graph comparing the effect of coal type on apparent viscosity of a gas saturated coal-oil slurry as a function of temperature.

Another factor which influences the onset and severity of unstable flow is the type of coal used in the slurry. FIG. 26 demonstrates the effect of coal type on viscosity. Ireland mine coal is a more reactive coal than Powhatan 6 coal. As a more reactive coal Ireland mine coal swells more quickly and to a greater extent than Powhatan 6. Thus, the viscosity of a slurry made with Ireland mine coal should be greater than one made with Powhatan 6 at temperatures up to the point of complete solvation. Viscosities of slurries made with Ireland Mine and Powhatan 6 coals are compared in FIG. 26. The slurry containing the more reactive coal, Ireland Mine, has greater viscosities up to a temperature of about 550° F. (288° C.) than the slurry made with Powhatan 6 coal. Accordingly, the transition to unstable flow occurs at the higher gas rate and with more severity for Ireland mine coal than for Powhatten 6.

Figure 27:
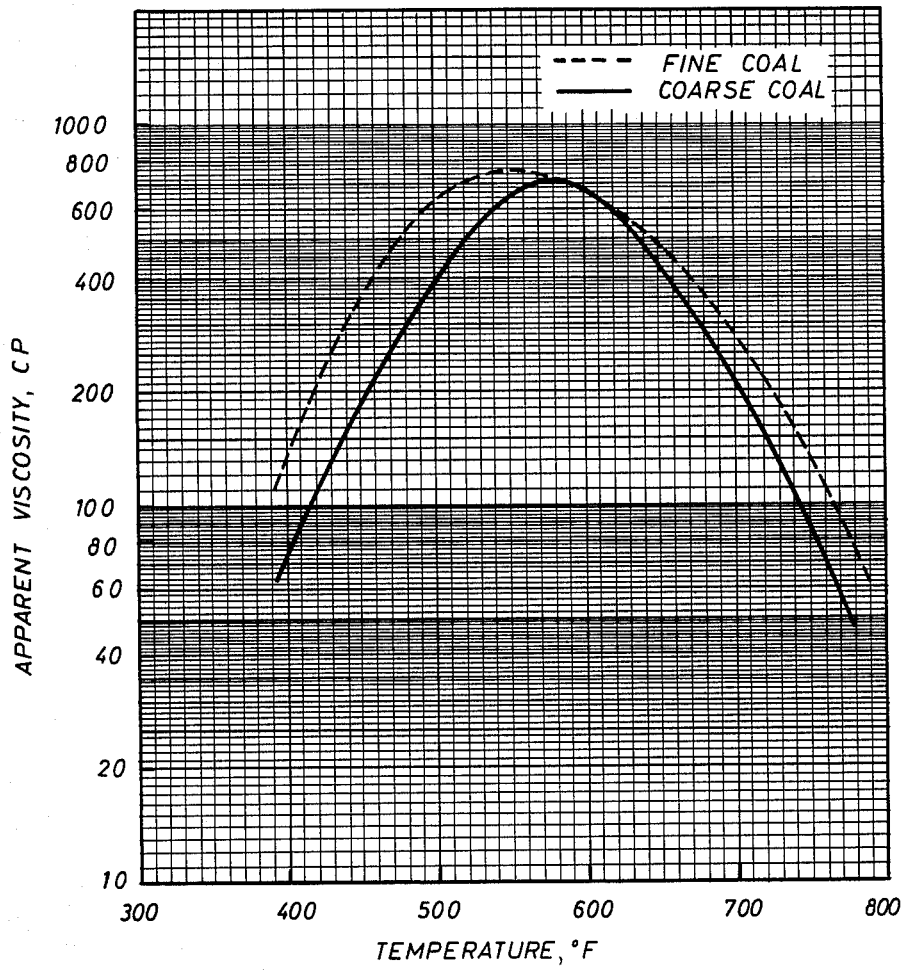
FIG. 27 is a graph comparing the effect of coal particle size distribution on the apparent viscosity of a gas saturated coal-oil slurry as a function of temperature.

Coal particle size distribution is still another factor affecting the onset and severity of unstable flow at a minimum critical gas rate. FIG. 27 shows the effect of coal particle size distribution on apparent slurry viscosity. As can be seen from FIG. 27 slurry made with finer coal, 80% passing through 200 mesh (U.S. Series) is more viscous than the slurry made with coarse coal, 80% passing through 30 mesh (U.S. Series) screen.

Applicants prefer that coal be classified so that at least 80% passes through a 30 mesh (U.S. Series) screen and that not more than 30% by weight of the coal pass through a 400 mesh (U.S. Series). Operation with coal ground so that 80% passes through 30 mesh (U.S. Series) screens is compared in FIG. 27 with operation with a finer grind of coal where 80% passes through 200 mesh (U.S. Series) screen. The overall viscosity is smaller with the coarse coal until the slurry reaches a temperature of about 600° F. Applicants believe the coal particles lose their identity at that temperature. This viscosity effect results in a transition into unstable flow at lower gas rates with slurries made with larger coal particles. Thus, it is possible to operate with less hydrogen flowing through the preheater when the slurry is made with larger coal particles.

The effect of increasing total solids while maintaining a constant coal concentration is similar to the effect of increased coal concentration with constant total solids concentration. The transition into unstable flow occurs at higher flow rates with more drastic consequences for a system containing greater amounts of total solids. Applicants prefer to operate with a total solids concentration of up to about 50% by weight. The most preferred total solids concentration is about 45% by weight.

Another factor which influences flow stability is the composition of the liquids in the recycle slurry. A slurry which is rich in high boiling liquids is more viscous than one rich in low boiling liquids. Consequently the slurry rich in high boiling liquids can be expected to undergo a sharper transition into unstable flow at a higher gas flow rate than one rich in low boiling liquids. Applicants prefer to operate with a recycle slurry having a minimum boiling point no lower than about 380° F. (193° C.).

Applicants further prefer that the recycle slurry be split off from the product stream after letdown. When the recycle stream is split off in this manner it is lean in middle distillate, liquids boiling between 380° F. (193° C.) and 600° F. (316° C.), because most of those liquids are flashed off in the letdown system. The slurry is rich in liquids boiling between about 600° F. (316° C.) and about 900° F. (482° C.), in SRC, and in normally solid dissolved coal boiling at temperatures in excess of 900° F. (482° C.). Applicants further prefer that the recycle slurry contain significant amounts of mineral residue, 5% at a minimum, and preferably 20% to 25%. Mineral residue is comprised of inorganic material and insoluble organic material. When the recycle slurry contains mineral residue the reaction stream in the dissolver is autocatalytic. No additional catalyst or catalyst rejuvenation is required.

Figure 28:
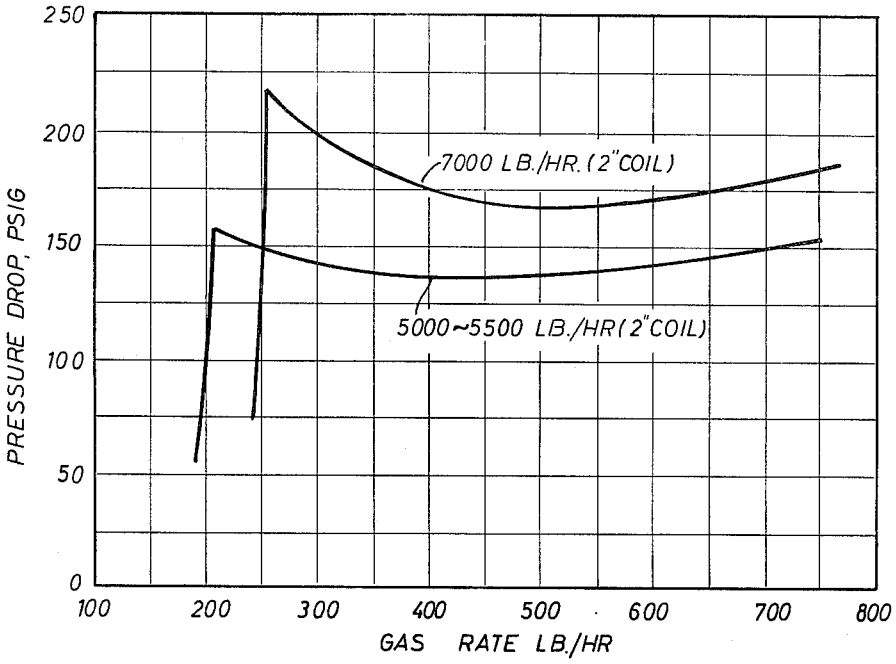
FIG. 28 is a graph comparing the effect of slurry feed rate on the overall pressure drop as a function of hydrogen containing gas feed rate at the inlet to the heating zone.

Slurry feed rate is another factor which influences the transition into unstable flow. As seen in FIG. 28, with increased feed rates the transition to unstable flow occurs at higher gas rates. Accordingly, with increased slurry feed rates it is necessary to operate with more hydrogen in the preheater.

Applicants have also observed an effect on the transition into unstable flow caused by variations in heat flux. With higher heat fluxes the transition occurs at higher gas rates. Also, with higher heat fluxes the degree of instability is more severe. Applicants prefer to first minimize overall pressure drop in the region of stable operation and then maximize heat flux while avoiding coking. Conservatively applicants prefer to keep the inside film temperature below 925° F. (496° C.) to avoid coking. Applicants believe that inside film temperatures of 950° F. (510° C.) or higher present serious risk of coking.

The factors listed above affecting the onset and severity of unstable flow conditions demonstrate that upsets in the reaction stream or shifts in the reaction feedstock can affect the rate at which the gas flow will be optimized. One embodiment of the present invention is ideally suited for use in plants where feedstocks will be changed from time to time. Further, since uniform mixing is impossible to obtain all of the time in a commercial setting this particular embodiment will be useful for compensating for flow conditions whenever the composition of the stream abruptly changes.

In this embodiment a computer is used to automatically calculate first the viscosity at various points along the coil so that a viscosity curve for the coil could be generated. The computer then can calculate for predetermined segments along the length of the coil a theoretical minimum superficial gas velocity at the inlet to the heater which will result in a gas holdup in the segment corresponding to a particular viscosity at least as great as the minimum design gas holdup. All of the calculated theoretical minimum superficial velocities for the coil can be compared so that the largest theoretical minimum superficial velocity can be determined. The same process can be carried out simultaneously to calculate a theoretical maximum superficial velocity at the inlet to the coil for each predetermined segment of the coil which will result in a gas holdup no greater than a design maximum gas holdup. In the same way the various calculated theoretical maximum superficial gas velocities can be compared to determine the smallest theoretical maximum superficial velocity so calculated. Then a valve at the inlet to the preheater can be adjusted to make sure that the actual superficial velocity of the gas falls between the largest theoretical minimum superficial velocity and the smallest theoretical maximum superficial velocity.

The computer can be programmed to perform such a feedback loop with the Duckler et al correlation for pressure drop in two-phase flow and the Hughmark correlation for gas holdup. The data base for such a program would require input of the mass flow rate of the slurry, the inside diameter of the tube, the density of the slurry and of the gas, both as a function of temperature, the viscosity of the gas as a function of temperature and the superficial velocity of the slurry at the inlet to the coil. To calculate viscosity the computer must be fed data from the coil. Some of these data will be direct; others will be derived. Those data include the actual mass flow rate of gas at the inlet to the coil, the volume fraction of slurry at the inlet to the coil, and pressure differences measured over predetermined increments of known length. With these data the computer can then develop an apparent gas saturated slurry viscosity as a function of temperature profile for the entire coil by solving the Duckler et al pressure drop correlation and the Hughmark gas holdup correlation. Alternatively, an apparent slurry viscosity profile can be generated by using a correlation which does not require knowledge of gas holdup. The Lockhart Martinelli pressure drop correlation should accurately generate a viscosity profile from pressure drop data.

Once an apparent viscosity profile of the gas saturated slurry has been generated for the stream flowing in the coil the Hughmark correlation can be used to calculate the minimum and maximum superficial velocities required to operate with a gas holdup falling between the design minimum and maximum gas holdup.

A further aspect of the present invention involves operation of the preheater with flow rates controlled to assure a slurry residence time greater than 1.5 minutes after the slurry has been heated to 450° F. The effect or residence time to decrease slurry viscosity can be seen in FIG. 29. This effect becomes evident at fluid temperatures above about 600° F. Although the kinetics of preheater reactions have not been established with certainty, applicants believe that the decrease in viscosity with increased residence time indicates a chemical reaction which is at least in part time dependent. The temperature at which the viscosity effect becomes evident, about 600° F., is a temperature usually associated with disintegration of the gel. Accordingly, applicants believe that disintegration of the gel is both temperature and space-time dependent with the space-time factor controlling.

EXAMPLE 1

Dry Powhatan No. 6 coal was pulverized at a rate 1794 lb/hr to a nominal 200 mesh size (80% passing through 200 (U.S. Series) mesh screen). The dried coal was then added to recycle slurry which was flowing at a rate of 3410 lb/hr. The recycle slurry was comprised of coal derived liquids with an approximate initial boiling point 320° F., of unreacted coal, and of ash. The resultant coal-oil slurry contained 30.1% by weight coal and 43.1% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 1½ in schedule 160 stainless steel. It had an inside diameter of 1.38 in. and a wall thickness of 0.281 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 514 lb/hr. The slurry was heated from an inlet temperature of 327° F. to an outlet temperature of 795° F. The pressure at the inlet was 2299 psig; at the outlet the pressure was 1888 psig.

The hydrogen containing gas added to the coal-oil slurry at the inlet comprised 88.5 mol % hydrogen, 6.2 mol % methane, 0.4 mol % ethane, 0.3 mol % propane, 0.1 mol % normal butane, 4.2 mol % carbon monoxide, and 0.4 mol % nitrogen. The recycle slurry used to prepare the coal-oil slurry comprised under 0.02 weight % water, 0.15 weight % naptha, 1.93 weight % middle distillate (b.p. 350° F. to 550° F.), 34.36 weight % heavy distillate (b.p. 550° F. to 850° F.), 63.34 weight % vacuum bottoms (b.p. greater than 850° F.). The vacuum bottoms contained approximately 22.5 weight % pyridine insoluble mineral residue (unconverted coal and inorganic material) and approximately 40.84 weight % solvent refined coal.

A plot of the fluid and skin temperature profiles is shown in FIG. 23*a* as the stable run.

The flow rate of the hydrogen containing gas was decreased first to approximately 400 lb/hr, then to approximately 300 lb/hr, then to approximately 240 lb/hr. As the gas rate was further decreased the pressure drop over the length of the coil increased so much that applicants were unable to locate the gas rate at which the pressure drop was a maximum. (Applicants' equipment could not register pressure drop greater than 500 psig). A plot of overall pressure drop as a function of gas rate is shown in FIG. 22.

As the gas rate was decreased from 100 lb/hr to 90 lb/hr the maximum skin temperature at the tube wall climbed from an acceptable value of 918° F. to an unacceptable value of 1000° F. A plot of maximum skin temperature as a function of gas flow rate is shown in FIG. 21.

EXAMPLE 2

Dry Powhatan No. 6 coal was pulverized at a rate 1749 lb/hr to a nominal 200 mesh size (80% passing through 200 (U.S. Series) mesh screen). The dried coal was then added to recycle slurry which was flowing at a rate of 3641 lb/hr. The recycle slurry was comprised of coal derived liquids with an approximate initial boiling point 320° F., of unreacted coal, and of ash. The resultant coal-oil slurry contained 29.6% by weight coal and 43.5% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 1½ in schedule 160 stainless steel. It had an inside diameter of 1.38 in. and a wall thickness of 0.281 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 267 lb/hr. The slurry was heated from an inlet temperature of 319° F. to an outlet temperature of 798° F. The pressure at the inlet was 2261 psig; at the outlet the pressure was 1874 psig.

The hydrogen containing gas added to the coal-oil slurry at the inlet comprised 86.7 mol % hydrogen, 7.2 mol % methane, 0.4 mol % ethane, 0.3 mol % propane, 0.1 mol % normal butane, 4.7 mol % carbon monoxide, and 0.4 mol % nitrogen. The recycle slurry used to prepare the coal-oil slurry comprised under 0.06 weight % water, 0.04 weight % naptha, 2.65 weight % middle distillate (b.p. 350° F. to 550° F.), 33.76 weight % heavy distillate (b.p. 550° F. to 850° F.),.63.49 weight % vacuum bottoms (b.p. greater than 850° F.). The vacuum bottoms contained approximately 22.5 weight % pyridine insoluble mineral residue (unreacted organic material and inorganic material) and approximately 41 weight % solvent refined coal.

The pressure drop data obtained was used to calculate a curve of apparent slurry viscosity as a function of temperature. This curve is shown in FIG. 26 as the Powhatan coal curve.

The gas flow rate was reduced first to approximately 220 lb/hr, then to approximately 176 lb/hr, and finally to approximately 130 lb/hr. The overall pressure drop decreased with decreases in gas rate. A plot of overall pressure drop as a function of gas flow rate is shown in FIG. 25 as the curve labeled 30% coal.

EXAMPLE 3

Dry Powhatan No. 6 coal was pulverized at a rate 2102 lb/hr to a nominal 200 mesh size (80% passing through 200 (U.S. Series) mesh screen). The dried coal was then added to recycle slurry which was flowing at a rate of 4185 lb/hr. The recycle slurry was comprised of coal derived liquids with an approximate initial boiling point 320° F., of unreacted coal, and of ash. The resultant coal-oil slurry contained 30.3% by weight coal and 43.0% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 1½ in schedule 160 stainless steel. It had an inside diameter of 1.38 in. and a wall thickness of 0.281 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 114 lb/hr. The slurry was heated from an inlet temperature of 318° F. to an outlet temperature of 787° F. The pressure at the inlet was 2235 psig; at the outlet the pressure was 2030 psig.

The hydrogen containing gas added to the coal-oil slurry at the inlet comprised 87.9 mol % hydrogen, 6.8 mol % methane, 0.4 mol % ethane, 0.3 mol % propane, 0.1 mol % normal butane, 4.0 mol % carbon monoxide, and 0.4 mol % nitrogen. The recycle slurry used to prepare the coal-oil slurry comprised under 0.06 weight % water, 0.09 weight % naptha, 2.22 weight % middle distillate (b.p. 350° F. to 550° F.), 33.43 weight % heavy distillate (b.p. 550° F. to 850° F.), 64.2 weight % vacuum bottoms (b.p. greater than 850° F.). The vacuum bottoms contained approximately 20.9 weight % pyridine insoluble mineral residue (undissolved organic material and inorganic material) and approximately 43.3 weight % solvent refined coal.

A plot of the bulk fluid and tube skin temperature profiles is shown in FIG. **23*b*** as the unstable run. A comparison of this run with run described in Example 1 demonstrates that the primary difference between the two runs was gas flow (514 lb/hr compared to 114 lb/hr). The effect of lower gas feed rate was to dramatically increase the difference between the bulk fluid temperature and the tube walls temperature all along the coil. The increased temperature difference between the bulk and the tube wall indicates inefficient heat transfer.

EXAMPLE 4

Dry Powhatan No. 6 coal was pulverized at a rate 1708 lb/hr to a nominal 200 mesh size (80% passing through 200 (U.S. Series) mesh screen). The dried coal was then added to recycle slurry which was flowing at a rate of 4520 lb/hr. The recycle slurry was comprised of coal derived liquids with an approximate initial boiling point 320° F., of unreacted coal, and of ash. The resultant coal-oil slurry contained 24.8% by weight coal and 42.0% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 1½ in schedule 160 stainless steel. It had an inside diameter of 1.38 in. and a wall thickness of 0.281 in. The coal was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 177 lb/hr. The slurry was heated from an inlet temperature of 315° F. to an outlet temperature of 799° F. The pressure at the inlet was 2264 psig; at the outlet the pressure was 1986 psig.

The hydrogen containing gas added to the coal-oil slurry at the inlet comprised 90.0 mol % hydrogen, 4.8 mol % methane, 0.3 mol % ethane, 0.2 mol % propane, 0.1 mol % normal butane, 4.1 mol % carbon monoxide, and 0.4 mol % nitrogen. The recycle slurry used to prepare the coal-oil slurry comprised under 0.01 weight % water, 0.05 weight % naptha, 1.2 weight % middle distillate (b.p. 350° F. to 550° F.), 29.72 weight % heavy distillate (b.p. 550° F. to 850° F.), 69.03 weight % vacuum bottoms (b.p. greater than 850° F.). The vacuum bottoms were comprised of approximately 26.4 weight % pyridine insoluble mineral residue (undissolved organic material and inorganic material) and approximately 42.6 weight % solvent refined coal.

The hydrogen containing gas flow rate was then decreased incrementally to about 100 lb/hr and then to approximately 60 lb/hr. The hydrogen containing gas rate was also increased to approximately 330 lb/hr. A plot of pressure drop as a function of gas flow rate is shown in FIG. 25 as the curve labeled 25% coal.

EXAMPLE 5

Dry Powhatan No. 6 coal was pulverized at a rate 2418 lb/hr to a nominal 200 mesh size (80% passing through 200 (U.S. Series) mesh screen). The dried coal was then added to recycle slurry which was flowing at a rate of 3204 lb/hr. The recycle slurry was comprised of coal derived liquids with an approximate initial boiling point 320° F., of unreacted coal, and of ash. The resultant coil-oil slurry contained 34.9% by weight coal and 42.0% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 1½ in schedule 160 stainless steel. It had an inside diameter of 1.38 in. and a wall thickness of 0.281 in. The coil was arranged in a round rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 190 lb/hr. The slurry was heated from an inlet temperature of 321° F. to an outlet temperature of 800° F. The pressure at the inlet was 2319 psi; at the outlet the pressure was 1946 psi.

The hydrogen containing gas added to the coal-oil slurry at the inlet comprised 88.98 mol % hydrogen, 6.0 mol % methane, 0.4 mol % ethane, 0.3 mol % propane, 0.1 mol % normal butane, 3.8 mol % carbon monoxide, and 0.3 mol % nitrogen. The recycle slurry used to prepare the coal-oil slurry comprised under 0.05 weight % water, 0.05 weight % naptha, 2.06 weight % middle distillate (b.p. 350° F. to 550° F.), 42.04 weight % heavy distillate (b.p. 550° F. to 850° F.), 55.8 weight % vacuum bottoms (b.p. greater than 850° F.). The vacuum bottoms comprised approximately 15.50 weight % pyridine insoluble mineral residue (undissolved organic material and inorganic material) and approximately 40.3 weight % solvent refined coal.

The hydrogen containing gas rate was increased to approximately 275 lb/hr. The hydrogen containin gas rate was also decreased to approximately 170 lb/hr and then to approximately 160 lb/hr. The overall pressure drop became so high at gas rates lower than 160 lb/hr that applicants were unable to locate the gas rate at which overall pressure drop was a maximum. A curve of overall pressure drop as a function of gas rate is shown in FIG. 25 as the curve label 35% coal.

EXAMPLE 6

Dry Ireland Mine coal was pulverized at a rate 1500 lb/hr to a nominal 200 mesh size (80% passing through 200 (U.S. Series) mesh screen). The dried coal was then added to recycle slurry which was flowing at a rate of 2712 lb/hr. The recycle slurry was comprised of coal derived liquids with an approximate initial boiling point 320° F., of unreacted coal, and of ash. The resultant coal-oil slurry contained 30.1% by weight coal and 42% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 1½ in schedule 160 stainless steel. It had an inside diameter of 1.38 in. and a wall thickness of 0.281 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 259 lb/hr. The slurry was heated from an inlet temperature of 289° F. to an outlet temperature of 804° F. The pressure at the inlet was 2217 psig; at the outlet the pressure was 1874 psig.

The hydrogen containing gas added to the coal-oil slurry at the inlet comprised 85.9 mol % hydrogen, 10.3 mol % methane, 1.3 mol % ethane, 0.5 mol % propane, 0.2 mol % normal butane, 0.8 mol % carbon monoxide, and 1.0 mol % nitrogen. The recycle slurry used to prepare the coal-oil slurry comprised under 0.07 weight % water, 0.07 weight % naptha, 2.76 weight % middle distillate (b.p. 350° F. to 550° F.), 40.61 weight % heavy distillate (b.p. 550° F. to 850° F.), 56.49 weight % vacuum bottoms (b.p. greater than 850° F.).

The pressure drop data obtained was used to calculate a curve of apparent slurry viscosity as a function of temperature. This curve is shown in FIG. 26 as the Ireland Mine curve.

EXAMPLE 7

Dry Powhatan No. 6 coal was pulverized at a rate 2105 lb/hr to a nominal 200 mesh size (80% passing through 200 (U.S. Series) mesh screen). The dried coal was then added to recycle slurry which was flowing at a rate of 3820 lb/hr. The recycle slurry was comprised of coal derived liquids with an approximate initial boiling point 320° F., of unreacted coal, and of ash. The resultant coal-oil slurry contained 30.3% by weight coal and 41.7% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 419 lb/hr. The slurry was heated from an inlet temperature of 321° F. to an outlet temperature of 808° F. The pressure at the inlet was 2200 psig; at the outlet the pressure was 1994 psig.

The hydrogen containing gas added to the coal-oil slurry at the inlet comprised 85.4 mol % hydrogen, 7.3 mol % methane, 1.0 mol % ethane, 0.4 mol % propane, 0.2 mol % normal butane, 5.5 mol % carbon monoxide, and 0.3 mol % nitrogen. The recycle slurry used to prepare the coal-oil slurry comprised under 0.01 weight % water, 0.08 weight % naptha, 2.82 weight % middle distillate (b.p. 350° F. to 550° F.), 36.48 weight % heavy distillate (b.p. 550° F. to 850° F.), 60.61 weight % vacuum bottoms (b.p. greater than 850° F.). The vacuum bottoms were comprised of approximately 20.70 weight % pyridine insoluble materials (unconverted inorganic material) and approximately 39.9 weight % solvent refined coal. The coal used was ground to a fine grind with the following classification: 100% passed through 30 mesh (U.S. Series) screen, 100% passed through 60 mesh (U.S. Series) screen, 99.2% by weight passed through 100 mesh (U.S. Series) screen, 79.91% by weight passed through 200 mesh (U.S. Series) screen, 56.33% by weight passed through 325 mesh (U.S. Series) screen, 47.14% by weight passed through 400 mesh (U.S. Series) screen.

The pressure drop profile obtained was used to calculate a profile of apparent viscosity of the gas saturated slurry as a function of temperature. This profile is shown in FIG. 27 as the fine coal curve.

EXAMPLE 8

Dry Powhatan No. 6 coal was pulverized at a rate 2150 lb/hr to a nominal 30 mesh size (80% passing through 30 (U.S. Series) mesh screen). The dried coal was then added to recycle slurry which was flowing at a rate of 4446 lb/hr. The recycle slurry was comprised of coal derived liquids with an approximate initial boiling point 320° F., of unreacted coal, and of ash. The resultant coal-oil slurry contained 30.6% by weight coal and 45.9% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 295 lb/hr. The slurry was heated from an inlet temperature of 308° F. to an outlet temperature of 794° F. The pressure at the inlet was 2157 psig; at the outlet the pressure was 1998 psig.

The hydrogen containing gas added to the coal-oil slurry at the inlet comprised 85.6 mol % hydrogen, 7.1 mol % methane, 0.6 mol % ethane, 0.4 mol % propane, 0.2 mol % normal butane, 5.6 mol % carbon monoxide, and 0.4 mol % nitrogen. The recycle slurry used to prepare the coal-oil slurry comprised under 0.06 weight % water, 0.12 weight % naptha, 3.05 weight % middle distillate (b.p. 350° F. to 550° F.), 30.23 weight % heavy distillate (b.p. 550° F. to 850° F.), 60.53 weight % vacuum bottoms (b.p. greater than 850° F.). The vacuum bottoms were comprised of approximately 24.16 weight % mineral residue (unconverted coal and mineral matter) and approximately 42.37 weight % solvent refined coal. The coal was ground to a coarse ground with the following classification: 98.68% by weight passed through 30 mesh (U.S. Series) screen, 85.24% by weight passed through 60 mesh (U.S. Series) screen, 64.24% by weight passed through 100 mesh (U.S. Series) screen, 42.56% by weight passed through 200 mesh (U.S. Series) screen, 24.87% by weight passed through 325 mesh (U.S. Series) screen and 21.44% by weight passed through 400 mesh (U.S. Series) screen.

EXAMPLE 9

Dry Powhatan No. 6 coal was pulverized at a rate 1675 lb/hr to a nominal 200 mesh size (80% passing through 200 (U.S. Series) mesh screen). The dried coal was then added to recycle slurry which was flowing at a rate of 3400 lb/hr. The recycle slurry was comprised of coal derived liquids with an approximate initial boiling point 320° F., of unreacted coal, and of ash. The resultant coal-oil slurry contained 30.0% by weight coal and 41.1% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 5578 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 195 lb/hr. The slurry was heated from an inlet temperature of 307° F. to an outlet temperature of 802° F. The pressure at the inlet was 1990 psig.

The hydrogen containing gas added to the coal-oil slurry at the inlet comprised 85.0 mol % hydrogen, 6.0 mol % methane, 0.7 mol % ethane, 0.4 mol % propane, 0.2 mol % normal butane, 7.2 mol % carbon monoxide, and 0.5 mol % nitrogen. The recycle slurry used to prepare the coal-oil slurry comprised under 0.1 weight % water, 0.1 weight % naptha, 2.2 weight % middle distillate (b.p. 350° F. to 550° F.), 47.2 weight % heavy distillate (b.p. 550° F. to 850° F.), 50.5 weight % vacuum bottoms (b.p. greater than 850° F.). The vacuum bottoms were comprised of approximately 18.2 weight % pyridine insoluble material (unconverted organic material and inorganic materiai) and 32.2 weight % solvent refined coal.

The overall pressure drop determined by adding the individual pressure dorps measured over segments of the coil, was 62 psig.

EXAMPLE 10

Dry Powhatan No. 6 coal was pulverized at a rate 1605 lb/hr to a nominal 200 mesh size (80% passing through 200 (U.S. Series) mesh screen). The dried coal was then added to recycle slurry which was flowing at a rate of 2950 lb/hr. The recycle slurry was comprised of coal derived liquids with an approximate initial boiling point 320° F., of unreacted coal, and of ash. The resultant coal-oil slurry contained 30.8% by weight coal and 43.3% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 5208 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube walls's temperature. It also had pressure differential taps along the length of the coil to provide an accurate pressure drop profile.

A stream of hydrogen containing gas was added to the slurry at the inlet to the preheater coil. The hydrogen containing gas was added at a rate 207 lb/hr. The slurry was heated from an inlet temperature of 323° F. to an outlet temperature of 798° F. The pressure at the inlet was 2053 psig.

The hydrogen containing gas added to the coal-oil slurry at the inlet comprised 88.0 mol % hydrogen, 5.3 mol % methane, 0.7 mol % ethane, 0.3 mol % propane, 0.1 mol % normal butane, 5.2 mol % carbon monoxide, and 0.4 mol % nitrogen. The recycle slurry used to prepare the coal-oil slurry comprised under 0.1 weight % water, 0.1 weight % naptha, 3.2 weight % middle distillate (b.p. 350° F. to 550° F.), 47.7 weight % heavy distillate (b.p. 550° F. to 850° F.), 48.9 weight % vacuum bottoms (b.p. greater than 850° F.). The vacuum bottoms were comprised of approximately 22 weight % pyridine insoluble material (undissolved organic material and inorganic material) and approximately 26.9 weight % solvent refined coal.

The overall pressures drop, calculated by adding the pressure drops measured across individual coils, was 157 psi.

EXAMPLE 11

Dry Powhatan No. 6 coal was pulverized at a rate 1613 lb/hr to a nominal 200 mesh size (80% passing through 200 (U.S. Series) mesh screen). The dried coal was then added to recycle slurry which was flowing at a rate of 2991 lb/hr. The recycle slurry was comprised of coal derived liquids with an approximate initial boiling point 320° F., of unreacted coal, and of ash. The resultant coal-oil slurry contained 31.6% by weight coal and 42.8% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 5103 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 422 lb/hr. The slurry was heated from an inlet temperature of 340° F. to an outlet temperature of 803° F. The pressure at the inlet was 2007 psig.

The hydrogen containing gas added to the coal-oil slurry at the inlet comprised 84.9 mol % hydrogen, 7.1 mol % methane, 1.3 mol % ethane, 0.6 mol % propane, 0.2 mol % normal butane, 5.5 mol % carbon monoxide, and 0.4 mol % nitrogen. The recycle slurry used to prepare the coal-oil slurry comprised under 0.2 weight % water, no naptha, 4.4 weight % middle distillate (b.p. 350° F. to 550° F.), 46.3 weight % heavy distillate (b.p. 550° F. to 850° F.), 49.1 weight % vacuum bottoms (b.p. greater than 850° F.). The vacuum bottoms comprised approximately 19.0 weight % pyridine insoluble material (undissolved organic material and inorganic material) and 30.1 weight % solvent refined coal.

The overall pressure drop calculated by adding incremental pressure drops measured along the length of the coil was 137 psi.

EXAMPLE 12

Dry Powhatan No. 6 coal was pulverized at a rate 1565 lb/hr to a nominal 200 mesh size (80% passing through 200 (U.S. Series) mesh screen). The dried coal was then added to recycle slurry which was flowing at a rate of 3020 lb/hr. The recycle slurry was comprised of coal derived liquids with an approximate initial boiling point 320° F., of unreacted coal, and of ash. The resultant coal-oil slurry contained 29.9% by weight coal and 43.0% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 5230 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 583 lb/hr. The slurry was heated from an inlet temperature of 336° F. to an outlet temperature of about 800° F. The pressure at the inlet was 2020 psig.

The hydrogen containing gas added to the coal-oil slurry at the inlet comprised 86.4 mol % hydrogen, 5.8 mol % methane, 0.8 mol % ethane, 0.4 mol % propane, 0.1 mol % normal butane, 6.0 mol % carbon monoxide, and 0.4 mol % nitrogen. The recycle slurry used to prepare the coal-oil slurry comprised under 0.1 weight % water, 0.1 weight % naptha, 2.1 weight % middle distillate (b.p. 350° F. to 550° F.), 47.3 weight % heavy distillate (b.p. 550° F. to 850° F.), 50.5 weight % vacuum bottoms (b.p. greater than 850° F.). The vacumm bottoms were comprised of approximately 22.7 weight % pyridine insoluble material (undissolved organic material and inorganic material) and 27.8 weight % solvent refined coal.

The overall pressure drop, calculated by adding incremental pressure drops measured along the entire coil, was 145 psi.

EXAMPLE 13

Dry Powhatan No. 6 coal was pulverized at a rate 1524 lb/hr to a nominal 200 mesh size (80% passing through 200 (U.S. Series) mesh screen). The dried coal was then added to recycle slurry which was flowing at a rate of 2890 lb/hr. The recycle slurry was comprised of coal derived liquids with an approximate initial boiling point 320° F., of unreacted coal, and of ash. The resultant coal-oil slurry contained 30.0% by weight coal and 41.4% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 5080 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 759 lb/hr. The slurry was heated from an inlet temperature of 333° F. to an outlet temperature of 802° F. The pressure at the inlet was 2040 psig.

The hydrogen containing gas added to the coal-oil slurry at the inlet comprised 86.2 mol % hydrogen, 5.9 mol % methane, 0.9 mol % ethane, 0.3 mol % propane, 0.2 mol % normal butane, 6.1 mol % carbon monoxide, and 0.4 mol % nitrogen. The recycle slurry used to prepare the coal-oil slurry comprised no water, and under 0.1 weight % naptha, 3.4 weight % middle distillate (b.p. 350° F. to 550° F.), 48.7 weight % heavy distillate (b.p. 550° F. to 850° F.), 47.9 weight % vacuum bottoms (b.p. greater than 850° F.). The vacuum bottoms were comprised of approximately 19.5 weight % pyridine insoluble material (undissolved organic material and inorganic material) and 28.4 weight % solvent refined coal.

The overall pressure drop, calculated by adding the incremental pressure dorps measured along the length of the coil, was 152 psi. The overall pressure drops for Examples 9 through 13 are plotted as a function of gas flow rate in the "5000–5500 lb/hr" curve of FIG. 28.

Example 14

Dry Powhatan No. 6 coal was pulverized at a rate 2208 lb/hr to a nominal 200 mesh size (80% passing through 200 (U.S. Series) mesh screen). The dried coal was then added to recycle slurry which was flowing at a rate of 4259 lb/hr. The recycle slurry was comprised of coal derived liquids with an approximate initial boiling point 320° F., of unreacted coal, and of ash. The resultant coal-oil slurry contained 31.3% by weight coal and 42.7% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 7061 lb/hr. The heating zone was a helical coil arranged in a rounded rectangle configuration. The coil was nominal 2" in sechedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 773 lb/hr. The slurry was heated from an inlet temperature of 344° F. to an outlet temperature of 802° F. The pressure at the inlet was 2071 psig.

The hydrogen containing gas added to the coal-oil slurry at the inlet comprised 84.2 mol % hydrogen, 7.0 mol % methane, 1.1 mol % ethane, 0.5 mol % propane, 0.2 mol % normal butane, 6.5 mol % carbon monoxide, and 0.5 mol % nitrogen. The recycle slurry used to prepare the coal-oil slurry comprised under 0.1 weight % water, 0.2 weight % naptha, 4.6 weight % middle distillate (b.p. 350° F. to 550° F.), 48.0 weight % heavy distillate (b.p. 550° F. to 850° F.), 47.0 weight % vacuum bottoms (b.p. greater than 850° F.). The vacuum bottoms were comprised of approximately 19.0 weight % pyridine insoluble material (undissolved organic material and inorganic material) and 28.0 weight % solvent refined coal.

The overall pressure drop, as calculated by adding the incremental pressure drops measured along the length of the coil, was 184 psi.

EXAMPLE 15

Dry Powhatan No. 6 coal was pulverized at a rate 2131 lb/hr to a nominal 200 mesh size (80% passing through 200 (U.S. Series) mesh screen). The dried coal was then added to recycle slurry which was flowing at a rate of 4263 lb/hr. The recycle slurry was comprised of coal derived liquids with an approximate initial boiling point 320° F., of unreacted coal, and of ash. The resultant coal-oil slurry contained 30.5% by weight coal and 42.2% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 6997 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 578 lb/hr. The slurry was heated from an inlet temperature of 338° F. to an outlet temperature of 799° F. The pressure at the inlet was 2038 psig.

The hydrogen containing gas added to the coal-oil slurry at the inlet comprised 84.5 mol % hydrogen, 7.6 mol % methane, 1.0 mol % ethane, 0.5 mol % propane, 0.1 mol % normal butane, 5.8 mol % carbon monoxide, and 0.4 mol % nitrogen. The recycle slurry used to prepare the coal-oil slurry comprised under 0.1 weight % water, 0.2 weight % naptha, 2.0 weight % middle distillate (b.p. 350° F. to 550° F.), 47.8 weight % heavy distillate (b.p. 550° F. to 850° F.), 49.9 weight % vacuum bottoms (b.p. greater than 850° F.). The vacuum bottoms comprised of approximately 18.5 weight % pyridine insolubles (undissolved organic material and inorganic material) and 31.4 weight % solvent refined coal.

The overall pressure drop, calculated by adding together the incremental pressure drops measured over the length of the coil, was 169 psi.

EXAMPLE 16

Dry Powhatan No. 6 coal was pulverized at a rate 2160 lb/hr to a nominal 200 mesh size (80% passing through 200 (U.S. Series) mesh screen). The dried coal was then added to recycle slurry which was flowing at a rate of 4143 lb/hr. The recycle slurry was comprised of coal derived liquids with an approximate initial boiling point 320° F., of unreacted coal, and of ash. The resultant coal-oil slurry contained 31.3% by weight coal and 42.4% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 6896 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 397 lb/hr. The slurry was heated from an inlet temperature of 335° F. to an outlet temperature of 800° F. The pressure at the inlet was 2038 psig.

The hydrogen containing gas added to the coal-oil slurry at the inlet comprised 85.0 mol % hydrogen, 7.3 mol % methane, 0.9 mol % ethane, 0.4 mol % propane, 0.1 mol % normal butane, 5.8 mol % carbon monoxide, and 0.4 mol % nitrogen. The recycle slurry used to prepare the coal-oil slurry comprised under 0.1 weight % water, 0.1 weight % naptha, 2.1 weight % middle distillate (b.p. 350° F. to 550° F.,) 48.0 weight % heavy distillate (b.p. 550° F. to 850° F.), 49.7 weight % vacuum bottoms (b.p. greater than 850° F.). The vacuum bottoms comprised of approximately 18.5 weight % pyridine insolubles (undissolved organic material and inorganic material) and 31.4 weight % solvent refined coal.

The overall pressure drop, calculated by adding together the incremental pressure drops measured over along the entire coil, was 177 psi.

EXAMPLE 17

Dry Powhatan No. 6 coal was pulverized at a rate 2131 lb/hr to a nominal 200 mesh size (80% passing through 200 (U.S. Series) mesh screen). The dried coal was then added to recycle slurry which was flowing at a rate of 4450 lb/hr. The recycle slurry was comprised of coal derived liquids with an approximate initial boiling point 320° F., of unreacted coal, and of ash. The resultant coal-oil slurry contained 29.9% by weight coal and 42.4% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 7129 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 396 lb/hr. The slurry was heated from an inlet temperature of 317° F. to an outlet temperature of 801° F. The pressure at the inlet was 2079 psig.

The hydrogen containing gas added to the coal-oil slurry at the inlet comprised 84.2 mol % hydrogen, 6.7 mol % methane, 1.0 mol % ethane, 0.5 mol % propane, 0.2 mol % normal butane, 6.8 mol % carbon monoxide, and 0.5 mol % nitrogen. The recycle slurry used to prepare the coal-oil slurry comprised under 0.1 weight % water, no naptha, 2.4 weight % middle distillate (b.p. 350° F. to 550° F.), 41.4 weight % heavy distillate (b.p. 550° F. to 850° F.), 55.7 weight % vacuum bottoms (b.p. greater than 850° F.). The vacuum bottoms comprised of approximately 20.2 weight % pyridine insoluble material (undissolved organic material and inorganic material) and 35.5 weight % solvent refined coal.

The overall pressure drop, calculated by adding together the incremental pressure drops measured over the length of the coil, was 173 psi.

EXAMPLE 18

Dry Powhatan No. 6 coal was pulverized at a rate 2130 lb/hr to a nominal 200 mesh size (80% passing through 200 (U.S. Series) mesh screen). The dried coal was then added to recycle slurry which was flowing at a rate of 4349 lb/hr. The recycle slurry was comprised of coal derived liquids with an approximate initial boiling point 320° F., of unreacted coal, and of ash. The resultant coal-oil slurry contained 30.5% by weight coal and 43.4% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 6979 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 282 lb/hr. The slurry was heated from an inlet temperature of 327° F. to an outlet temperature of 795° F. The pressure at the inlet was 2142 psig.

The hydrogen containing gas added to the coal-oil slurry at the inlet comprised 85.4 mol % hydrogen, 6.6 mol % methane, 0.7 mol % ethane, 0.3 mol % propane, 0.1 mol % normal butane, 6.3 mol % carbon monoxide, and 0.6 mol % nitrogen. The recycle slurry used to prepare the coal-oil slurry comprised under 0.1 weight % water, no naptha, 3.4 weight % middle distillate (b.p. 350° F. to 550° F.), 39.5 weight % heavy distillate (b.p. 550° F. to 850° F.), 57.0 weight % vacuum bottoms (b.p. greater than 850° F.). The vacuum bottoms were comprised of approximately 20.4 weight % pyridine insolubles (undissolved organic materials and inorganic material) and 36.7 weight % solvent refined coal.

The overall pressure drop, calculated by adding together the incremental pressure drops measured over the length of the coil, was 219 psi.

EXAMPLE 19

Dry Powhatan No. 6 coal was pulverized at a rate 2130 lb/hr to a nominal 200 mesh size (80% passing through 200 (U.S. Series) mesh screen). The dried coal was then added to recycle slurry which was flowing at a rate of 4350 lb/hr. The recycle slurry was comprised of coal derived liquids with an approximate initial boiling point 320° F., of unreacted coal, and of ash. The resultant coal-oil slurry contained 30.5% by weight coal and 43.4% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 6980 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 268 lb/hr. The slurry was heated from an inlet temperature of 320° F. to an outlet temperature of 799° F. The pressure at the inlet was 2140 psig.

The hydrogen containing gas added to the coal-oil slurry at the inlet comprised 85.4 mol % hydrogen, 6.7 mol % methane, 0.7 mol % ethane, 0.3 mol % propane, 0.1 mol % normal butane, 6.3 mol % carbon monoxide, and 0.6 mol % nitrogen. The recycle slurry used to prepare the coal-oil slurry comprised under 0.1 weight % water, no naptha, 3.4 weight % middle distillate (b.p. 350° F. to 550° F.), 39.5 weight % heavy distillate (b.p. 550° F. to 850° F.), 57.0 weight % vacuum bottoms (b.p. greater than 850° F.). The vacuum bottoms comprised of approximately 20.4 weight % pyridine insoluble material (undissolved organic material and inorganic material) and 36.7 weight % solvent refined coal.

The overall pressure drop, calculated by adding together the incremental pressure drops measured along the coil, was 210 psi.

EXAMPLE 20

Dry Powhatan No. 6 coal was pulverized at a rate 1699 lb/hr to a nominal 200 mesh size (80% passing through 200 (U.S. Series) mesh screen). The dried coal was then added to recycle slurry which was flowing at a rate of 4423 lb/hr. The recycle slurry was comprised of coal derived liquids with an approximate initial boiling point 320° F., of unreacted coal, and of ash. The resultant coal-oil slurry contained 24.8% by weight coal and 40% by weight total solids. The total solids percentage includes coal, recycled ash, and unconverted coal. The coal and recycle slurry were then mixed thoroughly by recirculation through a blend tank in order to achieve a homogeneous slurry.

The slurry was then fed to a heating zone at a rate of 6854 lb/hr. The heating zone was a helical coil arranged in a rounded rectangle configuration. The coil was nominal 2" in schedule 160 stainless steel. It had an inside diameter of 1.689 in. and a wall thickness of 0.344 in. The coil was arranged in a rounded rectangle of thirteen and a half turns. The coil also included instrumentation designed to provide precise profiles of both the bulk fluid's temperature and the tube wall's temperature. It also had pressure differential taps along the length of the coil to provide an accurate pressure drop profile.

A stream of hydrogen containing gas was added to the slurry at the inlet to the preheater coil. The hydrogen containing gas was added at a rate 255 lb/hr. The slurry was heated from an inlet temperature of 326° F. to an outlet temperature of 795° F. The pressure at the inlet was 1973 psig.

The recycle slurry used to prepare the coal-oil slurry comprised no water, 0.01 weight % naptha, 2.5 weight % middle distillate (b.p. 350° F. to 550° F.), 36.8 weight % heavy distillate (b.p. 550° F. to 850° F.), 60.8 weight % vacuum bottoms (b.p. greater than 850° F.). The vacuum bottoms comprised of approximately 23.6 weight % pyridine insolubles (undissolved organic material and inorganic material) and 37.2 weight % solvent refined coal.

The overall pressure drop, calculated by adding together the incremental pressure drops measured over the length of the coil, was 53 psi.

Figure 29:
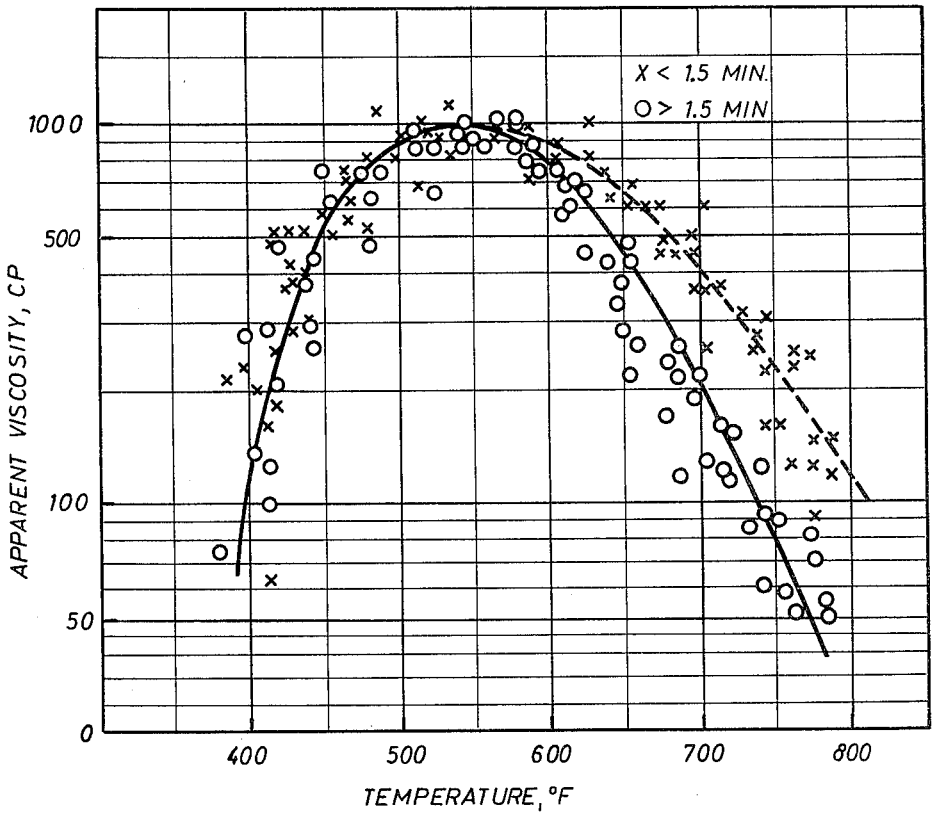
FIG. 29 is a graph comparing the effect of slurry residence time on the apparent viscosity of a gas saturated coal-oil slurry as a function of temperature.

The overall pressure drops of Examples 14 through 20 are plotted as a function of gas rate in the 7000 lb/hr curve of FIG. 29.

The foregoing descriptions have been directed to particular preferred embodiments in accordance with requirements of the patent statutes for the purposes of illustration and explanation. It will be apparent however, to those skilled in the art that many modifications and changes in the procedure set forth above will be possible without departing from the scope and spirit of the invention. It is the applicants' intention that the following claims be interpreted to embrace all such modifications and variations.

We claim:

1. A process for heating a coal-oil slurry in a heating zone comprising controllably heating in a flowing stream a coal-oil slurry and a gas containing at least about 70 mol per cent hydrogen while controlling the volume ratio of slurry to gas so as to maintain homogeneous flow in the portion of the heating zone where the bulk temperature of the coal-oil slurry is raised from about 500° F. (260° C.) to about 600° F. (332° C.).

2. The process of claim 1 further comprising maintaining homogeneous flow in segments of the heating zone where the bulk temperature of the coal-oil slurry is raised from about 450° F. (232° C.) to about 650° F. (343° C.).

3. The process of claim 1 further comprising maintaining homogeneous flow throughout the entire heating zone.

4. A process of claim 1 further comprising maintaining a minimum average heat flux of 6,000 btu/hr-ft$^2$ (16,200 kcal/hr-m$^2$) throughout the heating zone.

5. A process of claim 2 further comprising maintaining a minimum average heat flux of 6,000 btu/hr-ft$^2$ (16,200 kcal/hr-m$^2$) throughout the heating zone.

6. A process of claim 3 further comprising maintaining a minimum average heat flux of 6,000 btu/hr-ft$^2$ (16,200 kcal/hr-m$^2$) throughout the heating zone.

7. The process of claim 1 wherein the coal-oil slurry is made from a coal selected from a group consisting of bituminous, sub-bituminous coals, and lignites.

8. The process of claim 1 further comprising controlling the flow rates of said slurry and gas and the rate of heating such that the slurry has a residence time in said heating zone of at least 1.5 minutes after the slurry temperature has risen to 450° F. (232° C.).

9. The process of claim 1 wherein the flowrates of said gas and said slurry are controlled such that the ratio of the average actual volume of gas to the average actual volume of slurry at the inlet of the heating zone is at least 1 to 1.

10. The process of claim 1 wherein the flow rates of said gas and said slurry are controlled such that the ratio of the average actual volume of gas to the average actual volume of slurry at the inlet of the heating zone is at least 2 to 1.

11. The process of claim 1 wherein the coal-oil slurry is prepared from a recycle slurry from a coal liquefaction process.

12. The process of claim 11 wherein the coal-oil slurry is prepared with a swelling coal having particles classified so that at least 80% by weight pass through a 30 mesh (U.S. Series) screen and no more than 30% pass through a 400 mesh (U.S. Series) screen.

13. The process of claim 1 further comprising controlling the velocity of said slurry so that it flows with a shear rate of at least 150 sec$^{-1}$.

14. The process of claim 13 further comprising controlling the velocity of said slurry so that it flows with a shear rate no greater than 300 sec$^{-1}$.

15. The process of claim 7 further comprising controlling the rate of heating so as to maintain an average heat flux throughout the heating zone ranging from:

8,000 to 12,000 btu/hr-ft$^2$ (21,600–32,400 kcal/hr-m$^2$) while the coal-oil slurry is heated to about 450° F. (232° C.), from 12,000 to 18,000 btu/hr-ft$^2$ (32,400–48,600 kcal/hr-m$^2$) while the coal-oil slurry is heated from about 450° F. (232° C.) to about 650° F. (343° C.), 8,000 to 12,000 btu/hr-ft$^2$ (21,600–32,400 kcal/hr-m$^2$) while coal-oil slurry is heated above 650° F. (343° C.); and to maintain a maximum inside film temperature of the slurry no greater than about 925° F. (425° C.).

16. A process for heating a coal-oil slurry in a heating zone comprising controllably heating in a flowing stream a coal-oil slurry and a gas containing at least about 70 mol percent hydrogen while maintaining a minimum gas holdup of about 0.4 and homogeneous flow in those segments of the heating zone where the bulk temperature of the coal-oil slurry is raised from about 500° F. (260° C.) to about 600° F. (332° C.).

17. The process of claim 16 further comprising maintaining homogeneous flow in those segments of the heating zone where the bulk temperature of the coal-oil slurry is raised from about 450° F. (232° C.) to about 650° F. (343° C.).

18. The process of claim 16 further comprising maintaining homogeneous flow throughout the entire heating zone.

19. A process of claim 16 further comprising maintaining a minimum holdup of at least 0.38.

20. The process of claim 19 further comprising maintaining homogeneous flow in the segments of the heating zone where the bulk temperature of the coal-oil slurry is heated from about 450° F. (232° C.) to about 650° F. (343° C.).

21. The process of claim 19 further comprising maintaining homogeneous flow throughout the entire heating zone.

22. A process of claim 19 further comprising maintaining a gas holdup not greater than 0.6.

23. The process of claim 22 further comprising maintaining homogeneous flow in the segments of the heating zone where the bulk temperature of the coal-oil slurry is heated from about 450° F. (232° C.) to about 650° F. (343° C.).

24. The process of claim 22 further comprising maintaining homogeneous flow throughout the entire heating zone.

25. A process of claim 16 further comprising maintaining a minimum average heat flux of 6,000 btu/hr-ft$^2$ (16,200 kcal/hr-m$^2$) throughout the heating zone.

26. A process of claim 17 further comprising maintaining a minimum average heat flux of 6,000 btu/hr-ft$^2$ (16,200 kcal/hr-m$^2$) throughout the heating zone.

27. A process of claim 24 further comprising maintaining a minimum average heat flux of 6,000 btu/hr-ft$^2$ (16,200 kcal/hr-m$^2$) throughout the heating zone.

28. A coal liquefaction process comprising:

preheating in a heating zone a coal-oil slurry and a hydrogen containing gas stream to a temperature ranging from about 700° F. (371° C.) to about 870° F. (466° C.); and reacting said preheated slurry with said gas at temperatures controlled between about 700° F. (371° C.) to about 870° F. (466° F.) and at hydrogen partial pressures ranging between about 1,000 lb/in$^2$ (690 newton/cm$^2$) and about 4,000 lb/in$^2$ (2,760 newton/cm$^2$) for hydrogenation and hydrocracking; wherein the coal-oil slurry at the inlet to the heating zone has a temperature between 250° F. (121° C.) and about 500° F. (260° C.), contains at least about 20% by weight swelling coal, and flows with a superficial velocity between 1.5 ft/sec (0.46 m/sec) and about 15 ft/sec (4.6 m/sec);

the hydrogen containing gas at the inlet to the heating zone contains at least 70 mol percent hydrogen, and flows with a superficial velocity between about 1 ft/sec (0.3 m/sec) and about 30 ft/sec (9 m/sec) and with hydrogen partial pressures between 1,000 lb/in$^2$ (690 newton/cm$^2$) and about 4,000 lb/in$^2$ (2,760 newton/cm$^2$);

the ratio of the average actual volume of said gas to the actual average volume of said slurry at the inlet to the heating zone is at least 1.0; and the coal-oil slurry and hydrogen containing gas stream maintains homogeneous flow throughout the heating zone in those segments of the heating zone where the bulk temperature of the coal-oil slurry is raised from about 500° F. (260° C.) to about 600° F. (332° C.).

29. The process of claim 28 wherein the coal-oil slurry and gas stream maintains homogeneous flow in those segments of the heating zone where the bulk temperature of the coal-oil slurry is raised from about 450° F. (232° C.) to about 650° F. (343° C.).

30. The process of claim 28 wherein the coal-oil slurry and gas stream maintains homogeneous flow throughout the entire heating zone.

31. The process of claim 28 wherein the ratio of the average actual volume of said gas to the average actual volume of said slurry at the inlet to the heating zone is at least about 2 to 1.

32. The process of claim 29 wherein the ratio of the average actual volume of said gas to the average actual volume of said slurry at the inlet to the heating zone is at least 2 to 1.

33. The process of any of claims 28 to 32 wherein the coal-oil slurry is prepared from a recycle slurry from a coal liquefaction process having a minimum boiling point of about 380° F. (193° C.) and a swelling coal selected from the group consisting of bituminous coals, sub-bituminous coals and lignites.

34. The process of claim 33 wherein the coal-oil slurry contains between about 25% and about 50% by weight total solids.

35. The process of claim 34 wherein the coal-oil slurry contains 30% by weight swelling bituminous coal and between 30% and 50% by weight total solids, and the hydrogen containing gas contains at least 90% by weight hydrogen.

36. The process of claim 35 wherein the coal particles are classified so that at least 80% by weight pass through a 30 mesh (U.S. Series) screen and no more than 30% by weight pass through a 400 mesh (U.S. Series) screen.

37. The process of any of claims 28 to 32 wherein:

the coal-oil slurry is preheated in the heating zone to a temperature between about 750° F. (399° C.) and about 860° F. (460° C.);

the coal-oil slurry is reacted in the reaction zone with the hydrogen containing gas at temperatures controlled between about 750° F. (399° C.) and 860° F. (460° C.) and at hydrogen partial pressures between 1,000 (690 newton/cm$^2$) and 2,500 lb/in$^2$ (1,725 newton/cm$^2$);

the coal-oil slurry at the inlet to the heating zone flows with a superficial velocity between about 4 ft/sec (1.2 m/sec) and about 10 ft/sec (3 m/sec);

the hydrogen containing gas at the inlet to the heating zone flows with a superficial velocity between about 10 ft/sec (3 m/sec) and about 15 ft/sec (4.6 m/sec).

38. The process of claim 37 wherein the hydrogen containing gas in the heating zone has the minimum holdup of about 0.4.

39. The process of claim 37 wherein the hydrogen containing gas in the heating zone has a minimum holdup of about 0.38.

40. The process of claim 37 further comprising controlling the rate of preheating so as to maintain an average heat flux throughout the heating zone ranging from:

8,000 to 12,000 btu/hr-ft$^2$ (21,600–32,400 kcal/hr-m$^2$) while the coal-oil slurry is heated to about 450° F. (232° C.);

from 12,000 to 18,000 btu/hr-ft$^2$ (32,400–48,600 kcal/hr-m$^2$) while the coal-oil slurry is heated from about 450° F. (232° C.) to about 650° F. (343° C.), and 8,000 to 12,000 btu/hr-ft$^2$ (21,600–32,400 kcal/hr-m$^2$) while coal-oil slurry is heated above 650° F. (343° C.).

41. The process of any of claims 28, 30, 32 or 36 further comprising controlling the flowrate of the coal-oil slurry and hydrogen containing gas stream in the heating zone and controlling the rate of preheating so that the coal-oil slurry remains in the heating zone at least 1.5 minutes after it has been preheated to 450° F. (232° C.).

* * * * *

UNITED STATES PATENT AND TRADEMARK OFFICE

CERTIFICATE OF CORRECTION

PATENT NO. : 4,424,108

DATED : January 3, 1984

INVENTOR(S) : Walter A. Braunlin, et al.

It is certified that error appears in the above-identified patent and that said Letters Patent is hereby corrected as shown below:

Column 51, line 23, delete "(466° F.) and insert therefor -- (466° C.) --.

Signed and Sealed this

*Twenty-sixth* Day of *March 1985*

[SEAL]

*Attest:*

DONALD J. QUIGG

*Attesting Officer*

*Acting Commissioner of Patents and Trademarks*